US007548853B2

(12) United States Patent
Shmunk et al.

(10) Patent No.: US 7,548,853 B2
(45) Date of Patent: Jun. 16, 2009

(54) SCALABLE COMPRESSED AUDIO BIT STREAM AND CODEC USING A HIERARCHICAL FILTERBANK AND MULTICHANNEL JOINT CODING

(76) Inventors: Dmitry V. Shmunk, #17-11/1 Russkaya St., Novosibirsk (RU) 630058; Richard J. Beaton, 7716 Dow Avenue, Bumaby, BC (CA)

( * ) Notice: Subject to any disclaimer, the term of this patent is extended or adjusted under 35 U.S.C. 154(b) by 239 days.

(21) Appl. No.: 11/452,001

(22) Filed: Jun. 12, 2006

(65) Prior Publication Data

US 2007/0063877 A1 Mar. 22, 2007

Related U.S. Application Data

(60) Provisional application No. 60/691,558, filed on Jun. 17, 2005.

(51) Int. Cl.
*G10L 19/00* (2006.01)

(52) U.S. Cl. ..... 704/219; 704/500

(58) Field of Classification Search ..... 704/219, 704/500

See application file for complete search history.

(56) References Cited

U.S. PATENT DOCUMENTS 4,074,069 A 2/1978 Tokura et al.
5,222,189 A 6/1993 Fielder
5,347,611 A 9/1994 Chang
5,388,209 A 2/1995 Akagiri
5,451,954 A 9/1995 Davis et al.
5,623,577 A 4/1997 Fielder
5,632,003 A 5/1997 Davidson et al.
5,845,243 A 12/1998 Smart et al.
5,890,106 A 3/1999 Bosi-Goldberg
5,890,125 A 3/1999 Davis et al.
5,956,674 A 9/1999 Smyth et al.
5,974,380 A 10/1999 Smyth et al.
5,983,191 A 11/1999 Ha et al.
5,987,181 A 11/1999 Makiyama et al.
5,987,407 A 11/1999 Wu et al.
6,006,179 A 12/1999 Wu et al.
6,029,126 A 2/2000 Malvar
6,091,773 A 7/2000 Sydorenko
6,092,041 A 7/2000 Pan et al.

(Continued)

OTHER PUBLICATIONS

U.S. Appl. No. 11/296,072 filed Dec. 6, 2005, Chmounk.

(Continued)

*Primary Examiner*—Daniel Abebe
(74) *Attorney, Agent, or Firm*—Blake Welcher; William Johnson; Eric Gifford

(57) ABSTRACT

A method for compressing audio input signals to form a master bit stream that can be scaled to form a scaled bit stream having an arbitrarily prescribed data rate. A hierarchical filterbank decomposes the input signal into a multi-resolution time/frequency representation from which the encoder can efficiently extract both tonal and residual components. The components are ranked and then quantized with reference to the same masking function or different psychoacoustic criteria. The selected tonal components are suitably encoded using differential coding extended to multichannel audio. The time-sample and scale factor components that make up the residual components are encoded using joint channel coding (JCC) extended to multichannel audio. A decoder uses an inverse hierarchical filterbank to reconstruct the audio signals from the tonal and residual components in the scaled bit stream.

45 Claims, 21 Drawing Sheets

U.S. PATENT DOCUMENTS

| | | | | |
|---|---|---|---|---|
| 6,098,039 | A | 8/2000 | Nishida | |
| 6,108,625 | A | 8/2000 | Kim | |
| 6,115,689 | A | 9/2000 | Malvar | |
| 6,122,618 | A | 9/2000 | Park | |
| 6,216,107 | B1 | 4/2001 | Rydbeck et al. | |
| 6,289,306 | B1 | 9/2001 | Van Der Vleuten et al. | |
| 6,356,870 | B1 | 3/2002 | Hui et al. | |
| 6,434,519 | B1 | 8/2002 | Manjunath et al. | |
| 6,446,037 | B1 | 9/2002 | Fielder et al. | |
| 6,664,913 | B1 | 12/2003 | Craven et al. | |
| 7,136,418 | B2 * | 11/2006 | Atlas et al. | 375/242 |
| 2002/0004718 | A1 | 1/2002 | Hasegawa | |
| 2002/0176353 | A1 * | 11/2002 | Atlas et al. | 370/203 |
| 2004/0024593 | A1 * | 2/2004 | Tsuji et al. | 704/215 |
| 2004/0122662 | A1 | 6/2004 | Crockett | |
| 2006/0015328 | A1 * | 1/2006 | Van Schijndel et al. | 704/219 |
| 2006/0149539 | A1 * | 7/2006 | Van Schijndel et al. | 704/222 |

OTHER PUBLICATIONS

U.S. Appl. No. 09/956,27, filed Sep. 13, 2001, Beaton et al.

Ken C. Pohlman, "Perceptual Coding," in Principles of Digital Audio, Chapter 10, pp. 303-362 and 430-436.

Int. Org. for Standardization, ISO/IEC JTCI/SC29/WG11, Coding of moving Pictures and audio, N3156, 1999/Maui version.

"AES Standart for Digital Audio" Audio Eng. Society, vol. 48, No. 6, Jun. 2000 pp. 565-583.

* cited by examiner

1900

| High Resolution Grid Sub-band | Grid 1 Sub-Band Number | | | | | | | | | | |
|---|---|---|---|---|---|---|---|---|---|---|---|
| | 0 | 1 | 2 | 3 | 4 | 5 | 6 | 7 | 8 | 9 | 10 |
| 0 | 1 | 0 | 0 | 0 | 0 | 0 | 0 | 0 | 0 | 0 | 0 |
| 1 | 0 | 1 | 0 | 0 | 0 | 0 | 0 | 0 | 0 | 0 | 0 |
| 2 | 0 | 0 | 1 | 0 | 0 | 0 | 0 | 0 | 0 | 0 | 0 |
| 3 | 0 | 0 | 0 | 1 | 0 | 0 | 0 | 0 | 0 | 0 | 0 |
| 4 | 0 | 0 | 0 | 0 | 0.5 | 0 | 0 | 0 | 0 | 0 | 0 |
| 5 | 0 | 0 | 0 | 0 | 0.5 | 0 | 0 | 0 | 0 | 0 | 0 |
| 6 | 0 | 0 | 0 | 0 | 0 | 0.5 | 0 | 0 | 0 | 0 | 0 |
| 7 | 0 | 0 | 0 | 0 | 0 | 0.33333 | 0.09524 | 0 | 0 | 0 | 0 |
| 8 | 0 | 0 | 0 | 0 | 0 | 0.16667 | 0.19048 | 0 | 0 | 0 | 0 |
| 9 | 0 | 0 | 0 | 0 | 0 | 0 | 0.28571 | 0 | 0 | 0 | 0 |
| 10 | 0 | 0 | 0 | 0 | 0 | 0 | 0.21429 | 0.05556 | 0 | 0 | 0 |
| 11 | 0 | 0 | 0 | 0 | 0 | 0 | 0.14286 | 0.11111 | 0 | 0 | 0 |
| 12 | 0 | 0 | 0 | 0 | 0 | 0 | 0.07143 | 0.16667 | 0 | 0 | 0 |
| 13 | 0 | 0 | 0 | 0 | 0 | 0 | 0 | 0.22222 | 0 | 0 | 0 |
| 14 | 0 | 0 | 0 | 0 | 0 | 0 | 0 | 0.17778 | 0.03636 | 0 | 0 |
| 15 | 0 | 0 | 0 | 0 | 0 | 0 | 0 | 0.13333 | 0.07273 | 0 | 0 |
| 16 | 0 | 0 | 0 | 0 | 0 | 0 | 0 | 0.08889 | 0.10909 | 0 | 0 |
| 17 | 0 | 0 | 0 | 0 | 0 | 0 | 0 | 0.04444 | 0.14545 | 0 | 0 |
| 18 | 0 | 0 | 0 | 0 | 0 | 0 | 0 | 0 | 0.18182 | 0 | 0 |
| 19 | 0 | 0 | 0 | 0 | 0 | 0 | 0 | 0 | 0.15152 | 0.02778 | 0 |
| 20 | 0 | 0 | 0 | 0 | 0 | 0 | 0 | 0 | 0.12121 | 0.05556 | 0 |
| 21 | 0 | 0 | 0 | 0 | 0 | 0 | 0 | 0 | 0.09091 | 0.08333 | 0 |
| 22 | 0 | 0 | 0 | 0 | 0 | 0 | 0 | 0 | 0.06061 | 0.11111 | 0 |
| 23 | 0 | 0 | 0 | 0 | 0 | 0 | 0 | 0 | 0.03030 | 0.13889 | 0 |
| 24 | 0 | 0 | 0 | 0 | 0 | 0 | 0 | 0 | 0 | 0.16667 | 0 |
| 25 | 0 | 0 | 0 | 0 | 0 | 0 | 0 | 0 | 0 | 0.13889 | 0 |
| 26 | 0 | 0 | 0 | 0 | 0 | 0 | 0 | 0 | 0 | 0.11111 | 0.05 |
| 27 | 0 | 0 | 0 | 0 | 0 | 0 | 0 | 0 | 0 | 0.08333 | 0.1 |
| 28 | 0 | 0 | 0 | 0 | 0 | 0 | 0 | 0 | 0 | 0.05556 | 0.15 |
| 29 | 0 | 0 | 0 | 0 | 0 | 0 | 0 | 0 | 0 | 0.02778 | 0.2 |
| 30 | 0 | 0 | 0 | 0 | 0 | 0 | 0 | 0 | 0 | 0 | 0.25 |
| 31 | 0 | 0 | 0 | 0 | 0 | 0 | 0 | 0 | 0 | 0 | 0.25 |

Fig. 19

For Group 5:

| F_dlt | 0 | 1 | 2 | 3 | 4 |
|---|---|---|---|---|---|
| 0 | 0.01 | -0.0037 | -0.002 | -0.00694 | -0.00184 |
| 1 | 0.04167 | 0 | 0 | -0.02083 | -0.01235 |
| 2 | 0.125 | 0.0558 | 0.03307 | -0.01645 | -0.00975 |
| 3 | 0.15625 | 0.0625 | 0.03704 | -0.00625 | -0.0037 |
| 4 | 0.1996 | 0.07813 | 0.0463 | 0.00227 | 0.00135 |
| 5 | 0.2 | 0.0625 | 0.03704 | 0.02083 | 0.00741 |
| 6 | 0.21277 | 0.05556 | 0.03292 | 0.02083 | 0.01235 |
| 7 | 0.21739 | 0.04735 | 0.02806 | 0.03472 | 0.02058 |
| 8 | 0.21739 | 0.03472 | 0.02058 | 0.04735 | 0.02806 |
| 9 | 0.21277 | 0.02083 | 0.01235 | 0.05556 | 0.03292 |
| 10 | 0.2 | 0.02083 | 0.00741 | 0.0625 | 0.03704 |
| 11 | 0.1996 | 0.00227 | 0.00135 | 0.07813 | 0.0463 |
| 12 | 0.15625 | -0.00625 | -0.0037 | 0.0625 | 0.03704 |
| 13 | 0.125 | -0.01645 | -0.00975 | 0.0558 | 0.03307 |
| 14 | 0.04167 | -0.02083 | -0.01235 | 0 | 0 |
| 15 | 0.01 | -0.00694 | -0.00184 | -0.0037 | -0.002 |

For Group 4:

| F_dlt | 0 | 1 | 2 | 3 | 4 |
|---|---|---|---|---|---|
| 0 | 0.005 | -0.02 | 0.0125 | -0.30303 | 0.002 |
| 1 | 0.10417 | 0.04 | -0.025 | 0.03333 | -0.02 |
| 2 | 0.125 | 0.01 | 0.01429 | -0.05 | -0.02 |
| 3 | 0.15625 | -0.00062 | -0.00049 | -0.00062 | -0.00049 |
| 4 | 0.15625 | -0.00062 | -0.00049 | -0.00062 | -0.00049 |
| 5 | 0.125 | -0.05 | -0.02 | 0.01 | 0.01429 |
| 6 | 0.10417 | 0.03333 | -0.02 | 0.04 | -0.025 |
| 7 | 0.005 | -0.30303 | 0.002 | -0.02 | 0.0125 |

For Group 3:

| F_dlt | 0 | 1 | 2 | 3 | 4 |
|---|---|---|---|---|---|
| 0 | 0.14286 | 0.125 | -0.02857 | -0.03571 | 0.02083 |
| 1 | 0.18182 | 0.05882 | 0.03333 | 0.02128 | 0.01 |
| 2 | 0.18182 | 0.02128 | 0.01 | 0.05882 | 0.03333 |
| 3 | 0.14286 | -0.03571 | 0.02083 | 0.125 | -0.02857 |

2000

Fig. 20

SCALABLE COMPRESSED AUDIO BIT STREAM AND CODEC USING A HIERARCHICAL FILTERBANK AND MULTICHANNEL JOINT CODING

CROSS-REFERENCE TO RELATED APPLICATIONS

This application claims benefit of priority under 35 U.S.C. 119(e) to U.S. Provisional Application No. 60/691,558 entitled "Scalable Compressed Audio Bit Stream and Codec Using a Hierarchical Filterbank" and filed on Jun. 17, 2005, the entire contents of which are incorporated by reference.

BACKGROUND OF THE INVENTION

1. Field of the Invention

This invention is related to the scalable encoding of an audio signal and more specifically to methods for performing this data rate scaling in an efficient matter for multichannel audio signals including hierarchical filtering, joint coding of tonal components and joint channel coding of time-domain components in the residual signal.

2. Description of the Related Art

The main objective of an audio compression algorithm is to create a sonically acceptable representation of an input audio signal using as few digital bits as possible. This permits a low data rate version of the input audio signal to be delivered over limited bandwidth transmission channels, such as the Internet, and reduces the amount of storage necessary to store the input audio signal for future playback. For those applications in which the data capacity of the transmission channel is fixed, and non-varying over time, or the amount, in terms of minutes, of audio that needs to be stored is known in advance and does not increase, traditional audio compression methods fix the data rate and thus the level of audio quality at the time of compression encoding. No further reduction in data rate can be effected without either recoding the original signal at a lower data rate or decompressing the compressed audio signal and then recompressing this decompressed signal at a lower data rate. These methods are not "scalable" to address issues of varying channel capacity, storing additional content on a fixed memory, or sourcing bit streams at varying data rates for different applications.

One technique used to create a bit stream with scalable characteristics, and circumvent the limitations previously described, encodes the input audio signal as a high data rate bit stream composed of subsets of low data rate bit streams These encoded low data rate bit streams can be extracted from the coded signal and combined to provide an output bit stream whose data rate is adjustable over a wide range of data rates. One approach to implement this concept is to first encode data at a lowest supported data rate, then encode an error between the original signal and a decoded version of this lowest data rate bit stream. This encoded error is stored and also combined with the lowest supported data rate bit stream to create a second to lowest data rate bit stream. Error between the original signal and a decoded version of this second to lowest data rate signal is encoded, stored and added to the second to lowest data rate bit stream to form a third to lowest data rate bit stream and so on. This process is repeated until the sum of the data rates associated with bit streams of each of the error signals so derived and the data rate of the lowest supported data rate bit stream is equal to the highest data rate bit stream to be supported. The final scalable high data rate bit stream is composed of the lowest data rate bit stream and each of the encoded error bit streams.

A second technique, usually used to support a small number of different data rates between widely spaced lowest and highest data rates, employs the use of more than one compression algorithm to create a "layered" scalable bit stream. The apparatus that performs the scaling operation on a bit stream coded in this manner chooses, depending on output data rate requirements, which one of the multiple bit streams carried in the layered bit stream to use as the coded audio output. To improve coding efficiency and provide for a wider range of scaled data rates, data carried in the lower rate bit streams can be used by higher rate bit streams to form additional higher quality, higher rate bit streams.

SUMMARY OF THE INVENTION

The present invention provides a method for encoding audio input signals to form a master bit stream that can be scaled to form a scaled bit stream having an arbitrarily prescribed data rate and for decoding the scaled bit stream to reconstruct the audio signals.

This is generally accomplished by compressing the audio input signals and arranging them to form a master bit stream. The master bit stream includes quantized components that are ranked on the basis of their relative contribution to decoded signal quality. The input signal is suitably compressed by separating it into a plurality of tonal and residual components, and ranking and then quantizing the components. The separation is suitably performed using a hierarchical filterbank. The components are suitably ranked and quantized with reference to the same masking function or different psychoacoustic criteria. The components may then be ordered based on their ranking to facilitate efficient scaling. The master bit stream is scaled by eliminating a sufficient number of the low ranking components to form the scaled bit stream having a scaled data rate less than or approximately equal to a desired data rate. The scaled bit stream includes information that indicates the position of the components in the frequency spectrum. A scaled bit stream is suitably decoded using an inverse hierarchical filterbank by arranging the quantized components based on the position formation, ignoring the missing components and decoding the arranged components to produce an output bit stream.

In one embodiment, the encoder uses a hierarchical filterbank to decompose the input signal into a multi-resolution time/frequency representation. The encoder extracts tonal components at each iteration of the HFB at different frequency resolutions, removes those tonal components from the input signal to pass a residual signal to the next iteration of the HFB and than extracts residual components from the final residual signal. The tonal components are grouped into at least one frequency sub-domain per frequency resolution and ranked according to their psychoacoustic importance to the quality of the coded signal. The residual components include time-sample components (e.g. a Grid G) and scale factor components (e.g. grids G0, G1) that modify the time-sample components. The time-sample components are grouped into at least one time-sample sub-domain and ranked according to their contribution to the quality of the decoded signal.

At the decoder, the inverse hierarchical filterbank may be used to extract both the tonal components and the residual components within one efficient filterbank structure. All components are inverse quantized and the residual signal is reconstructed by applying the scale factors to the time samples. The frequency samples are reconstructed and added to the reconstructed time samples to produce the output audio signal. Note the inverse hierarchical filterbank may be used at the decoder regardless of whether the hierarchical filterbank was used during the encoding process.

In an exemplary embodiment, the selected tonal components in a multichannel audio signal are encoded using differential coding. For each tonal component, one channel is selected as the primary channel. The channel number of the primary channel and its amplitude and phase are stored in the bit stream. A bit-mask is stored that indicates which of the other channels include the indicated tonal component, and should therefore be coded as secondary channels. The difference between the primary and secondary amplitudes and phases are then entropy-coded and stored for each secondary channel in which the tonal component is present.

In an exemplary embodiment, the time-sample and scale factor components that make up the residual signal are encoded using joint channel coding (JCC) extended to multichannel audio. A channel grouping process first determines which of the multiple channels may be jointly coded and all channels are formed into groups with the last group possibly being incomplete.

Additional objects, features and advantages of the present invention are included in the following discussion of exemplary embodiments, which discussion should be read with the accompanying drawings. Although these exemplary embodiments pertain to audio data, it will be understood that video, multimedia and other types of data may also be processed in similar manners.

BRIEF DESCRIPTION OF THE DRAWINGS

FIG. 19 is a G1 mapping table;

FIG. 20 is a table of base function synthesis correction coefficients; and

DESCRIPTION OF EXEMPLARY EMBODIMENTS

The present invention provides a method for compressing and encoding audio input signals to form a master bit stream that can be scaled to form a scaled bit stream having an arbitrarily prescribed data rate and for decoding the scaled bit stream to reconstruct the audio signals. A hierarchical filterbank (HFB) provides a multi-resolution time/frequency representation of the input signal from which the encoder can efficiently extract both the tonal and residual components. For multichannel audio, joint coding of tonal components and joint channel coding of residual components in the residual signal is implemented. The components are ranked on the basis of their relative contribution to decoded signal quality and quantized with reference to a masking function. The master bit stream is scaled by eliminating a sufficient number of the low ranking components to form the scaled bit stream having a scaled data rate less than or approximately equal to a desired data rate. The scaled bit stream is suitably decoded using an inverse hierarchical filterbank by arranging the quantized components based on position information, ignoring the missing components and decoding the arranged components to produce an output bit stream. In one possible application, the master bit stream is stored and than scaled down to a desired data rate for recording on another media or for transmission over a bandlimited channel. In another application, in which multiple scaled bit streams are stored on media, the data rate of each stream is independently and dynamically controlled to maximize perceived quality while satisfying an aggregate data rate constrain on all of the bit streams.

As used herein the terms "Domain", "sub-domain", and "component" describe the hierarchy of scalable elements in the bit stream. Examples will include:

| Domain | Sub-Domain | Component |
|---|---|---|
| Tonal | 1024-point resolution transform (4 sub-frames) | Tonal component (phase/amplitude/position) |
| Residual Scale factor Grids | Grid 1 | Scale factor within Grid 1 |
| Residual Subbands | Set of all time samples in sub-band 3 | Each time sample in subband 3 |

Scalable Bit Stream Encoder with a Residual Coding Topology

Figure 1:
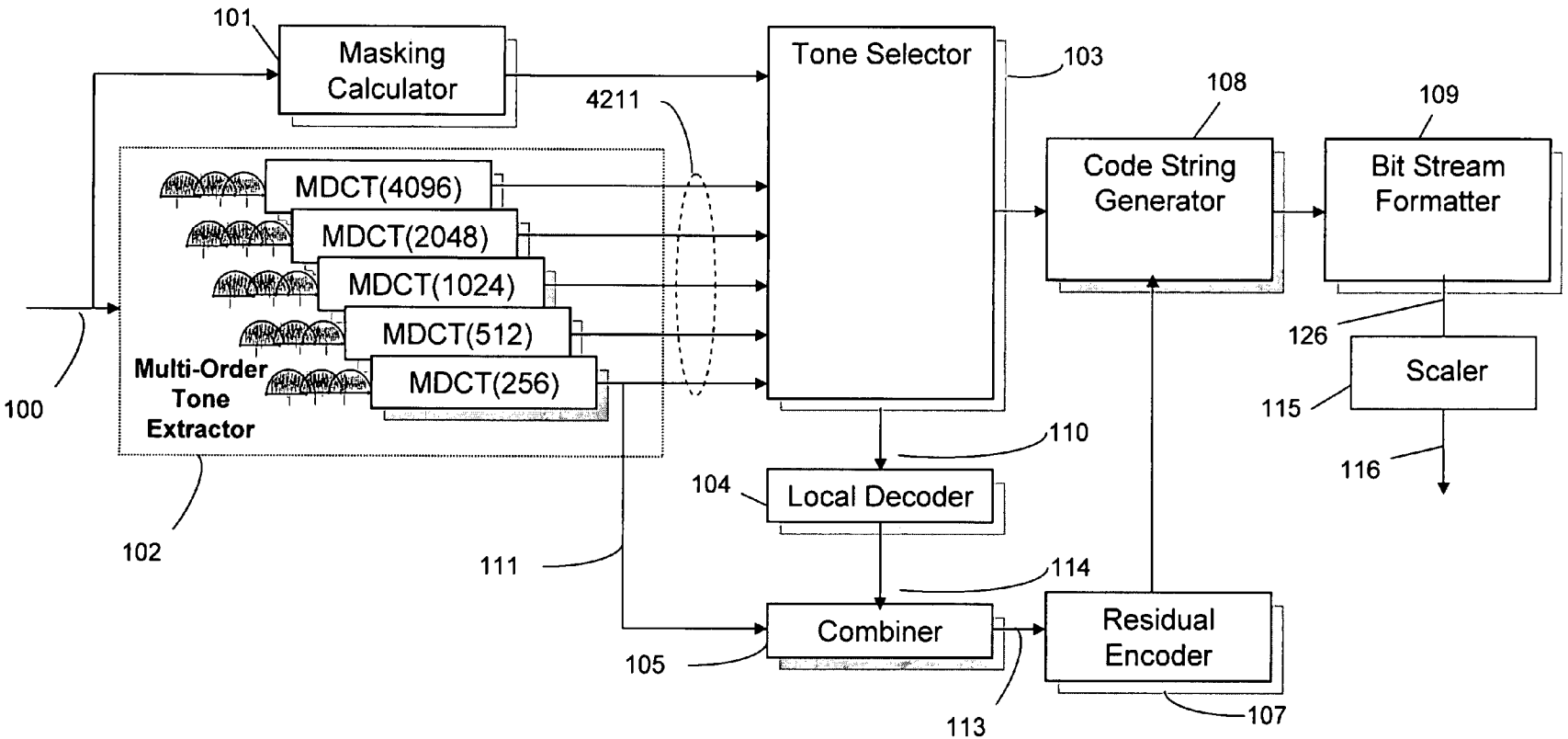
FIG. 1 is a block diagram illustration of a scalable bit stream encoder using a residual coding topology according to the present invention.

As shown in FIG. 1, in an exemplary embodiment a scalable bit stream encoder uses a residual coding topology to scale the bit stream to an arbitrary data rate by selectively eliminating the lowest ranked components from the core (tonal components) and/or the residual (time-sample and scale factor) components. The encoder uses a hierarchical filterbank to efficiently decompose the input signal into a multi-resolution time/frequency representation from which the encoder can efficiently extract the tonal and residual components. The hierarchical filterbank (HFB) described herein for providing the multi-resolution time/frequency representation can be used in many other applications in which such a representation of an input signal is desired. A general description of the hierarchical filterbank and its configuration for use in the audio encoder are described below as well as the modified HFB used by the particular audio encoder.

The input signal 100 is applied to both Masking Calculator 101 and Multi-Order Tone Extractor 102. Masking Calculator 101 analyzes input signal 100 and identifies a masking level as a function of frequency below which frequencies present in input signal 101 are not audible to the human ear. Multi-Order Tone Extractor 102 identifies frequencies present in input signal 101 using, for example, multiple overlapping FFTs or as shown a hierarchical filterbank based on MDCTs, which meet psychoacoustic criteria that have been defined for tones, selects tones according to this criteria, quantizes the amplitude, frequency, phase and position components of these selected tones, and places these tones into a tone list. At each iteration or level, the selected tones are removed from the input signal to pass a residual signal forward. Once complete, all other frequencies that do not meet the criteria for tones are extracted from the input signal and output from Multi-Order Tone Extractor 102, specifically the last stage of the hierarchical filterbank MDCT(256), in the time domain on line 111 as the final residual signal.

Figure 7:
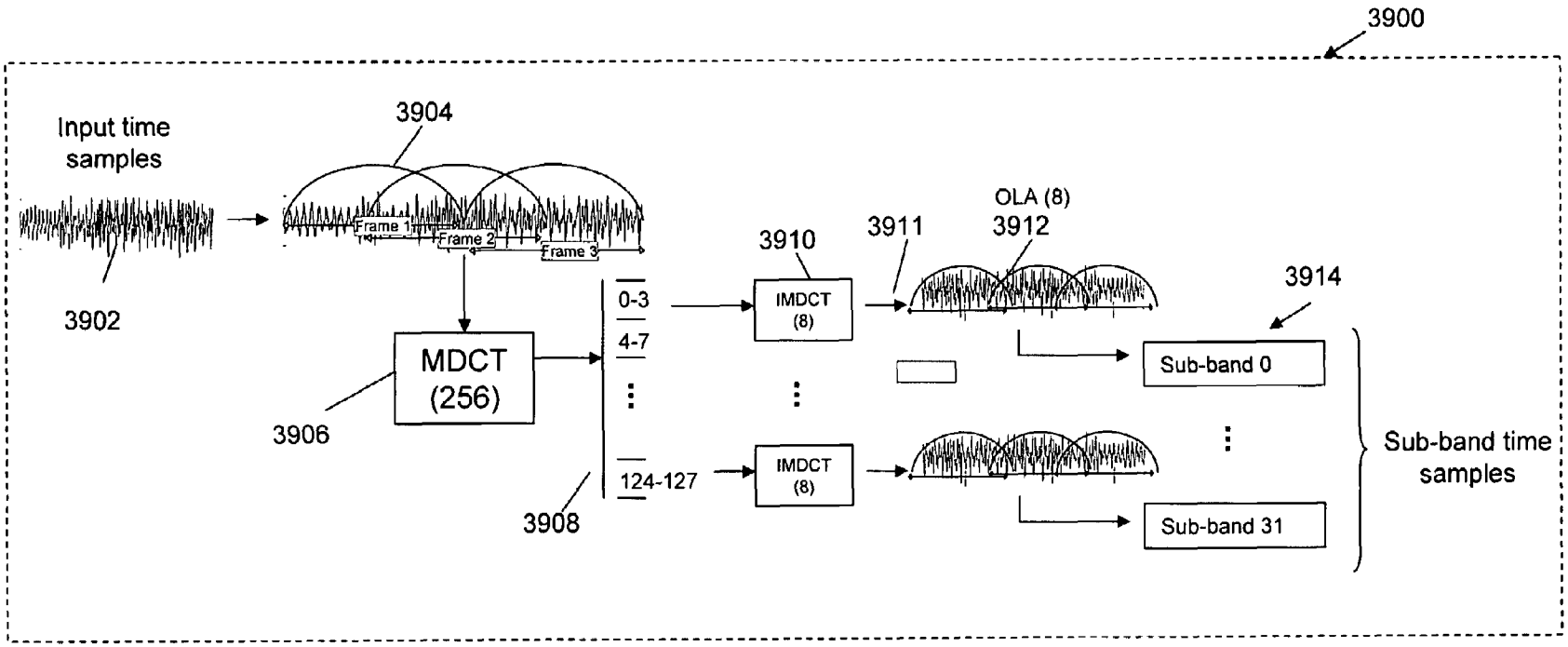
FIG. 7 is a block diagram of an exemplary implementation of a hierarchical analysis filterbank for use in the encoder.

Multi-Order Tone Extractor 102 uses, for example, five orders of overlapping transforms, starting from the largest and working down to the smallest, to detect tones through the use of a base function. Transforms of size: 8192, 4096, 2048, 1024, and 512 are used respectively, for an audio signal whose sampling rate is 44100 Hz. Other transform sizes could be chosen. FIG. 7 graphically shows how the transforms overlap each other. The base function is defined by the equations:

$$F(t; A, l, f, \varphi) = A \cdot \frac{1-\cos\left(\frac{2\pi}{l}\cdot t\right)}{2} \cdot \sin\left(\frac{2\pi}{l}\cdot f \cdot t + \varphi\right) \quad t \in [0, l]$$

$$F(t;, A, l, f, \varphi) = 0; \quad t \notin [0, l]$$

where:

$A_i$=Amplitude=$(Re_i \cdot Re_i + Im_i \cdot Im_i) - (Re_{i+1} \cdot Re_{i+1} + Im_{i+1} \cdot Im_{i+1})$ t=time (t∈N being a positive integer value)

l=transform size as a power of 2 (l∈512, 1024, . . . , 8192)

ϕ=phase f=frequency $$\left(f \in \left[1, \frac{l}{2}\right]\right)$$

Tones detected at each transform size are locally decoded using the same decode process as used by the decoder of the present invention, to be described later. These locally decoded tones are phase inverted and combined with the original input signal through time domain summation to form the residual signal that is passed to the next iteration or level of the HFB.

The masking level from Masking Calculator 101 and the tone list from Multi-Order Tone Extractor 102 are inputs to the Tone Selector 103. The Tone Selector 103 first sorts the tone list provided to it from Multi-Order Tone Extractor 102 by relative power over the masking level provided by Masking Calculator 101. It then uses an iterative process to determine which tonal components will fit into a frame of encoded data in the master bit stream. The amount of space available in a frame for tonal components depends on the predetermined, before scaling, data rate of the encoded master bit stream. If the entire frame is allocated for tonal components then no residual coding is performed. In general, some portion of the available data rate is allocated for the tonal components with the remainder (minus overhead) reserved for the residual components.

Channel groups are suitably selected for multichannel signals and primary/secondary channels identified within each channel group according to a metric such as contribution to perceptual quality. The selected tonal components are preferably stored using differential coding. For stereo audio, the two-bit field indicates the primary and secondary channels. The amplitude/phase and differential amplitude/phase are stored for the primary and secondary channels, respectively. For multichannel audio the primary channel is stored with its amplitude and phase and a bit-mask (See FIG. 9) is stored for all secondary channels with differential amplitude/phase for the included secondary channels. The bit-mask indicates which other channels are coded jointly with the primary channel and is stored in the bit stream for each tonal component in the primary channel.

During this iterative process, some or all of the tonal components that are determined not to fit in a frame may be converted back into the time domain and combined with residual signal 111. If, for example, the data rate is sufficiently high, then typically all of the deselected tonal components are recombined. If, however, the data rate is lower, the relatively strong 'deselected' tonal components are suitably left out of the residual. This has been found to improve perceptual quality at lower data rates. The deselected tonal components represented by signal 110, are locally decoded via Local Decoder 104 to convert them back into the time domain on line 114 and combined with Residual Signal 111 from Multi-Order Tone Extractor 102 in Combiner 105 to form a combined Residual signal 113. Note that the signals appearing on 114 and 111 are both time domain signals so that this combining process can be easily affected. The combined Residual Signal 113 is further processed by the Residual Encoder 107.

Figure 21:
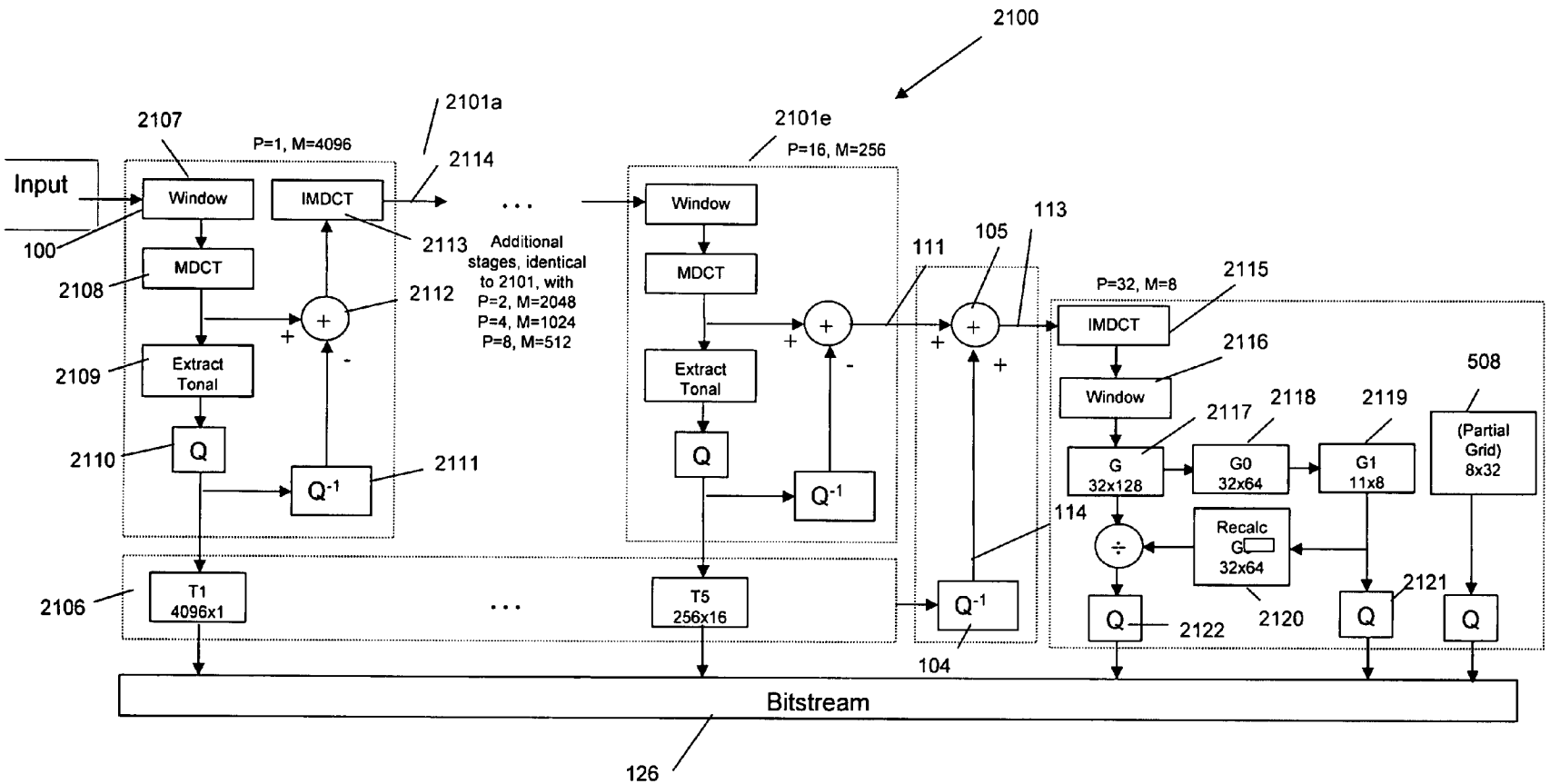
FIGS. 21 and 22 are functional block diagrams of the encoder and decoder, respectively, illustrating an application of the multiresolution time/frequency representation of the hierarchical filterbank in an audio encoder/decoder.

The first action performed by Residual Encoder 107 is to process the combined Residual Signal 113 through a filter bank which subdivides the signal into critically sampled time domain frequency sub-bands. In a preferred embodiment, when the hierarchical filterbank is used to extract the tonal components, these time-sample components can be read directly out of the hierarchical filterbank thereby eliminating the need for a second filterbank dedicated to the residual signal processing. In this case, as shown in FIG. 21, the Combiner 104 operates on the output of the last stage of the hierarchical filterbank (MDCT(256)) to combine the 'deselected' and decoded tonal components 114 with the residual signal 111 prior to computing the IMDCT 2106, which produces the sub-band time-samples (See also FIG. 7 steps 3906, 3908 and 3910). Further decomposition, quantization and arrangement of these sub-bands into psychoacoustically relevant order are then performed. The residual components (time-samples and scale factors) are suitably coded using joint channel coding in which the time-samples are represented by a Grid G and the scale factors by Grids G0 and G1 (See FIG. 11). The joint coding of the residual signal uses partial grids, applied to channel groups, which represent the ratio of signal energies between primary channel and secondary channel groups. The groups are selected (dynamically or statically) through cross correlations, or other metrics. More than one channel can be combined and used as a primary channel (e.g. L+R primary, C secondary). The use of scale factor grids partial, G0, G1 over time/frequency dimensions is novel as applied to these multichannel groups, and more than one secondary channel can be associated with a given primary channel. The individual grid elements and time samples are ranked by frequency with lower frequencies being ranked higher. The grids are ranked according to bit rate. Secondary channel information is ranked with lower priority than primary channel information.

The Code String Generator 108 takes input from the Tone Selector 103, on line 120, and Residual Encoder 107 on line 122, and encodes values from these two inputs using entropy coding well known in the art into bit stream 124. The Bit Stream Formatter 109 assures that psychoacoustic elements from the Tone Selector 103 and Residual Encoder 107, after being coded through the Code String Generator 108, appear in the proper position in the master bit stream 126. The 'rankings' are implicitly included in the master bit stream by the ordering of the different components.

A scaler 115 eliminates a sufficient number of the lowest ranked encoded components from each frame of the master bit stream 126 produced by the encoder to form a scaled bit stream 116 having a data rate less than or approximately equal to a desired data rate.

Hierarchical Filterbank

The Multi-Order Tone Extractor 102 preferably uses a 'modified' hierarchical filterbank to provide a multi-resolution time/frequency resolution from which both the tonal components and the residual components can be efficiently extracted. The HFB decomposes the input signal into transform coefficients at successively lower frequency resolutions and back into time-domain sub-band samples at successively finer time scale resolution at each successive iteration. The tonal components generated by the hierarchical filterbank are exactly the same as those generated by multiple overlapping FFTs however the computational burden is much less. The Hierarchical Filterbank addresses the problem of modeling the unequal time/frequency resolution of the human auditory system by simultaneously analyzing the input signal at different time/frequency resolutions in parallel to achieve a nearly arbitrary time/frequency decomposition. The hierarchical filterbank makes use of a windowing and overlap-add step in the inner transform not found in known decompositions. This step and the novel design of the window function allow this structure to be iterated in an arbitrary tree to achieve the desired decomposition, and could be done in a signal-adaptive manner.

As shown in FIG. 21, a single-channel encoder 2100 extracts tonal components from the transform coefficients at each iteration 2101*a*, 2101*e*, quantizes and stores the extracted tonal components in a tone list 2106. Joint coding of the tones and residual signals for multichannel signals is discussed below. At each iteration the time-domain input signal (residual signal) is windowed 2107 and an N-point MDCT is applied 2108 to produce transform coefficients. The tones are extracted 2109 from the transform coefficients, quantized 2110 and added to the tone list. The selected tonal components are locally decoded 2111 and subtracted 2112 from the transform coefficients prior to performing the inverse transform 2113 to generate the time-domain sub-band samples that form the residual signal 2114 for the next iteration of the HFB. A final inverse transform 2115 with relatively lower frequency resolution than the final iteration of the HFB is performed on the final combined residual 113 and windowed 2116 to extract the residual components G 2117. As described previously, any 'deselected' tones are locally decoded 104 and combined 105 with residual signal 111 prior to computation of the final inverse transform. The residual components include time-sample components (Grid G) and scale-factor components (Grid G0, G1) that are extracted from Grid G in 2118 and 2119. Grid G is recalculated 2120 and Grid G and G1 are quantized 2121, 2122. The calculation of Grids G, G1 and G0 is described below. The quantized tones on the tone list, Grid G and scale factor Grid G1 are all encoded and placed in the master bit stream. The removal of the selected tones from the input signal at each iteration and the computation of the final inverse transform are the modifications imposed on the HFB by the audio encoder.

A fundamental challenge in audio coding is the modeling of the time/frequency resolution of human perception. Transient signals, such as a handclap, require a high resolution in the time domain, while harmonic signals, such as a horn, require high resolution in the frequency domain to be accurately represented by an encoded bit stream. But it is a well-known principle that time and frequency resolution are inverses of each other and no single transform can simultaneously render high accuracy in both domains. The design of an effective audio codec requires balancing this tradeoff between time and frequency resolution.

Known solutions to this problem utilize window switching, adapting the transform size to the transient nature of the input signal (See K. Brandenburg et al., "The ISO-MPEG-Audio Codec: A Generic Standard for Coding of High Quality Digital Audio", Journal of Audio Engineering Society, Vol. 42, No. 10, October, 1994). This adaptation of the analysis window size introduces additional complexity and requires a detection of transient events in the input signal. To manage algorithmic complexity, the prior art window switching methods typically limit the number of different window sizes to two. The hierarchical filterbank discussed herein avoids this coarse adjustment to the signal/auditory characteristics by representing/processing the input signal by a filterbank which provides multiple time/frequency resolutions in parallel.

There are many filterbanks, known as hybrid filterbanks, which decompose the input signal into a given time/frequency representation. For example, the MPEG Layer 3 algorithm described in ISO/IEC 11172-3 utilizes a Pseudo-Quadrature Mirror Filterbank followed by an MDCT transform in each subband to provide the desired frequency resolution. In our hierarchical filterbank we utilize a transform, such as an MDCT, followed by the inverse transform (e.g. IMDCT) on groups of spectral lines to perform a flexible time/frequency transformation of the input signal.

Unlike hybrid filterbanks, the hierarchical filterbank uses results from two consecutive, overlapped outer transforms to compute 'overlapped' inner transforms. With the hierarchical filterbank it is possible to aggregate more then one transform on top of the first transform. This is also possible with prior-art filterbanks (e.g. tree-like filterbanks), but is impractical due to the fast degradation of frequency-domain separation with increase in number of levels. The hierarchical filterbank avoids this frequency-domain degradation at the expense of some time-domain degradation. This time-domain degradation can, however, be controlled through the proper selection of window shape(s). With the selection of the proper analysis window, the coefficients of the inner transform can also be made invariant to time shifts equal to the size of inner transform (not to the size of the outmost transform as in conventional approaches).

A suitable window W(x) referred to herein as the "Shmunk Window", for use with the hierarchical filterbank is defined by:

$$W^2(x) = \frac{128 - 150\cos\left(\frac{2\pi x}{L}\right) + 25\cos\left(\frac{6\pi x}{L}\right) - 3\cos\left(\frac{10\pi x}{L}\right)}{256}$$

Where x it the time domain sample index (0<x<=L), and L is the length of the window in samples.

Figure 2B:
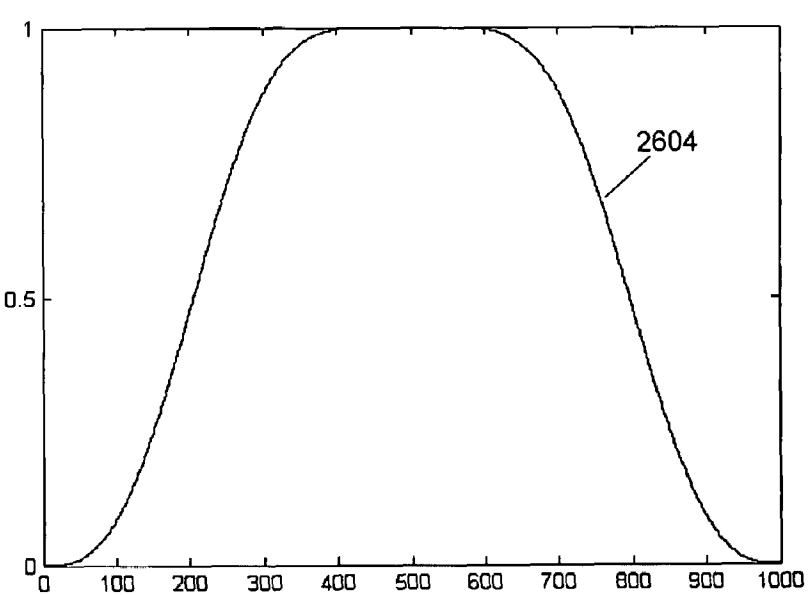
FIGS. 2*a* and 2*b* are frequency and time domain representations of a Shmunk window for use with the hierarchical filterbank.
Figure 2A:
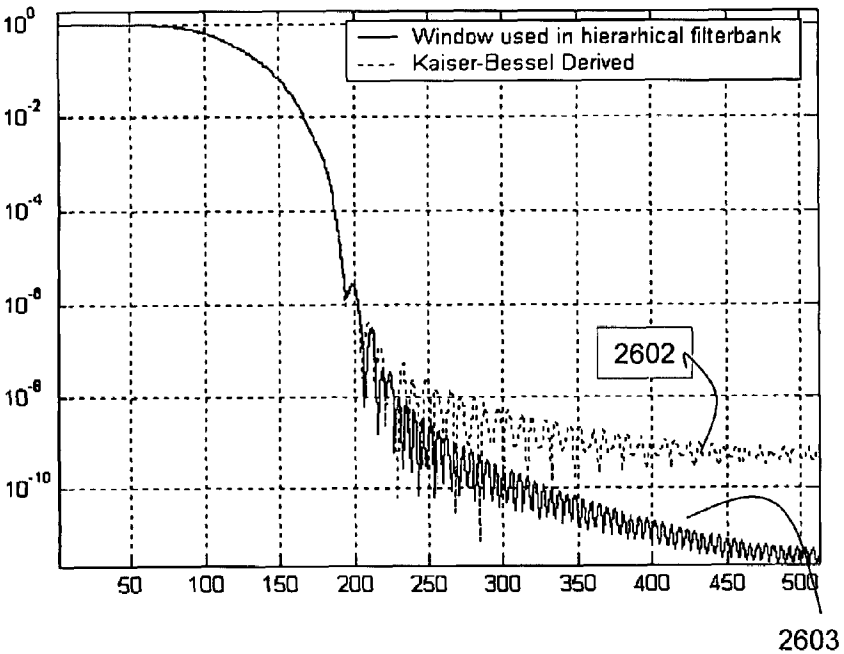

The frequency response 2603 of the Shmunk window in comparison with the commonly used Kaiser-Bessel derived window 2602 is shown in FIG. 2*a*. It can be seen that the two windows are similar in shape but the sidelobe attenuation is greater with the proposed window. The time-domain response 2604 of the Shmunk window is shown in FIG. 2*b*.

Figure 3:
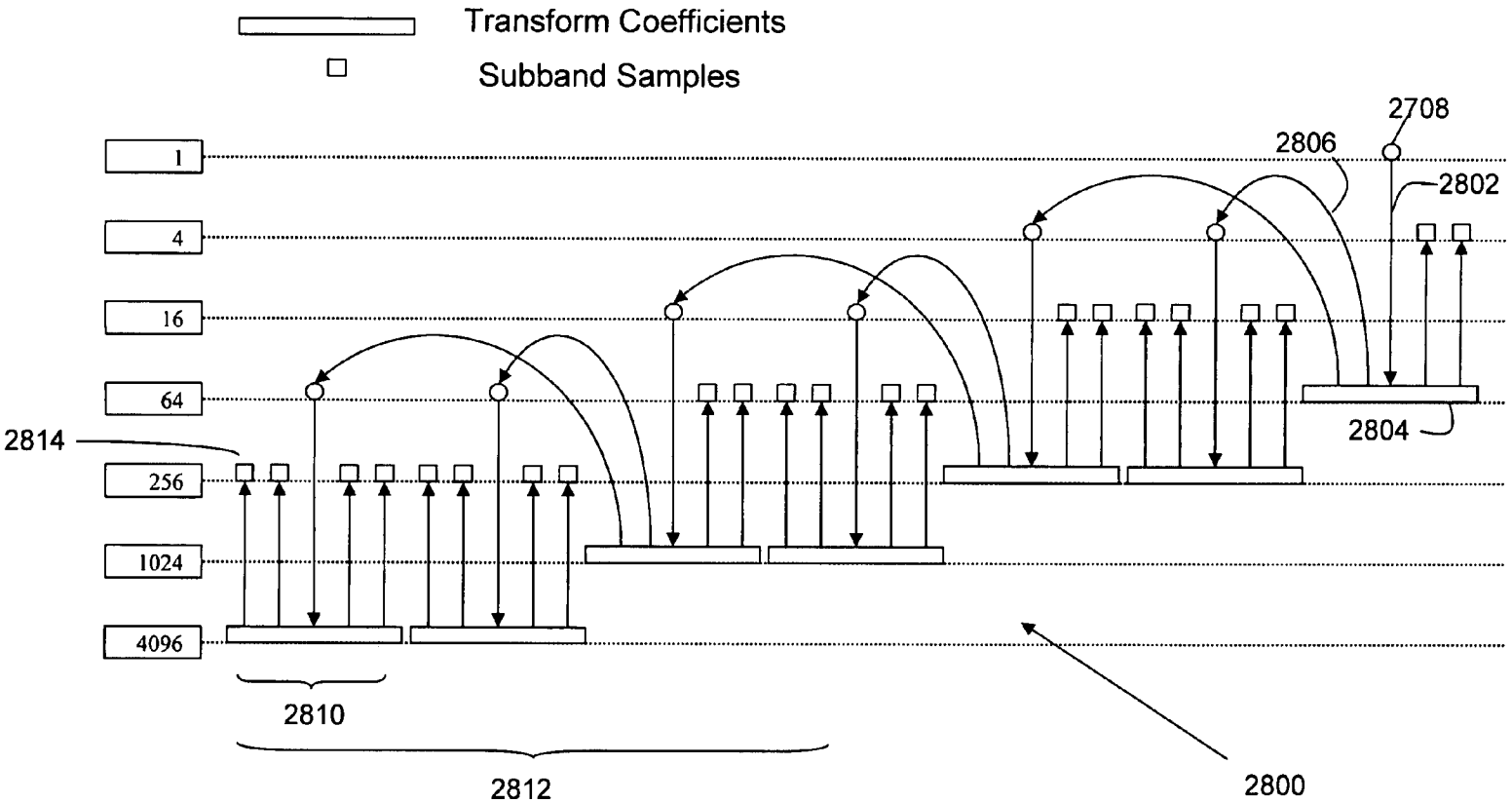
FIG. 3 is an illustration of a hierarchical filterbank for providing a multi-resolution time/frequency representation of an input signal from which both tonal and residual components can be extracted with the present invention.
Figure 4:
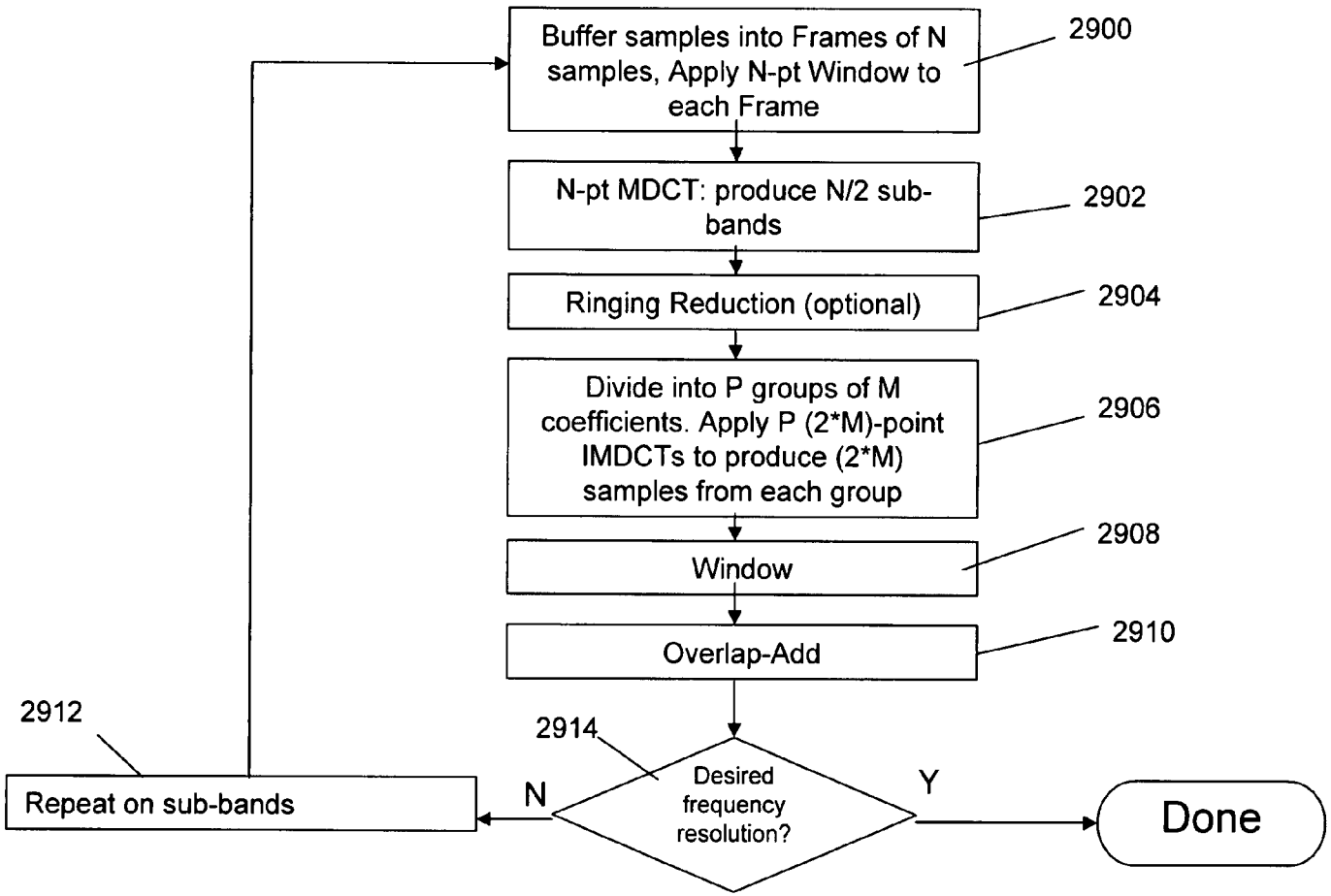
FIG. 4 is a flowchart of the steps associated with the hierarchical filterbank.
Figure 5A:
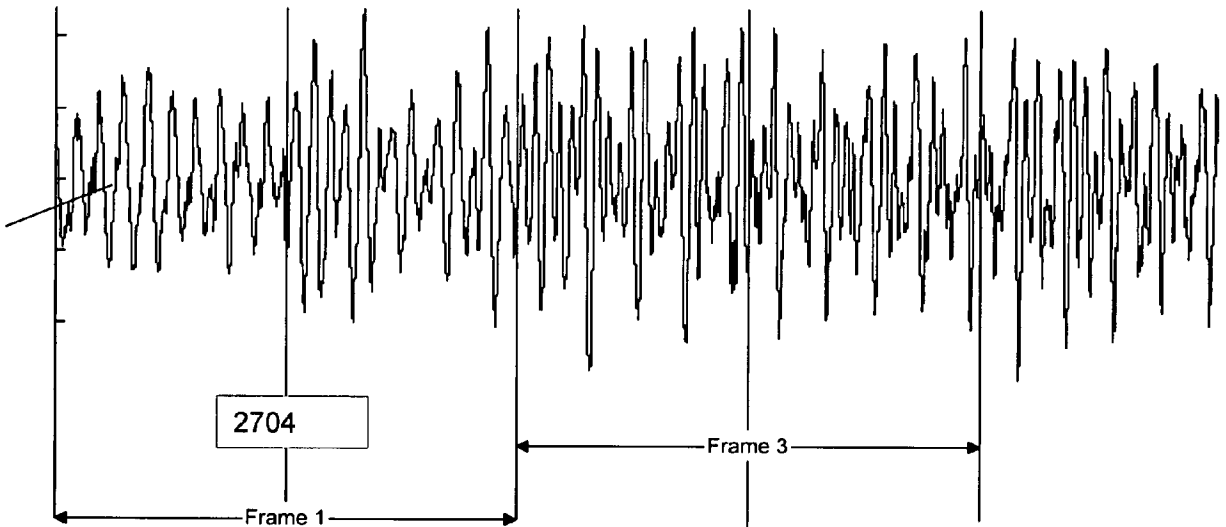
FIGS. 5*a* through 5*c* illustrate an 'overlap-add' windowing.

A hierarchical filterbank of general applicability for providing a time/frequency decomposition is illustrated in FIGS. 3 and 4. The HFB would have to be modified as described above for use in the audio codec. In FIG. 3, the number at each dotted line represents the number of equally spaced frequency bins at each level (though not all of these bins are calculated). Downward arrows represent a N-point MDCT transform resulting in N/2 subbands. Upward arrows represent an IMDCT which takes N/8 subbands and transforms them into N/4 time samples within one subband. Each square represents one sub-band. Each rectangle represents N/2 sub-bands. The hierarchical filterbank performs the following steps:

(a) As shown in FIG. 5*a*, the input signal samples 2702 are buffered into Frames of N samples 2704, and each Frame is multiplied by an N-sample window function (FIG. 5*b*) 2706 to produce N windowed samples 2708 (FIG. 5*c*) (step 2900);

(b) As shown in FIG. 3, an N-point Transform (represented by the downward arrow 2802 in FIG. 3) is applied to the windowed samples 2708 to produce N/2 transform coefficients 2804 (step 2902);

(c) Optionally ringing reduction is applied to one or more of the transform coefficients 2804 by applying a linear combination of one or more adjacent transform coefficients (step 2904);

(d) The N/2 transform coefficients 2804 are divided into P groups of Mi coefficients, such that the sum of the $M_i$ coefficients is $$N/2\left(\sum_{i=1}^{P} M_i = N/2\right);$$

(e) For each of P groups, a (2*$M_i$)-point inverse transform (represented by the upward arrow 2806 in FIG. 3) is applied to the transform coefficients to produce (2*$M_i$) sub-band samples from each group (step 2906);

(d) In each sub-band, the (2*$M_i$) sub-band samples are multiplied by a (2*$M_i$)-point window function 2706 (step 2908);

(e) In each sub-band, the $M_i$ previous samples are overlapped and added to corresponding current values to produce $M_i$ new samples for each sub-band (step 2910);

(f) N is set equal to the previous Mi and select new values for P and Mi, and (g) The above steps are repeated (step 2912) on one or more of the sub-bands of $M_i$ new samples using the successively smaller transform sizes for N until the desired time/transform resolution is achieved (step 2914). Note, steps may be iterated on all of the sub-bands, only the lowest sub-bands or any desired combination thereof. If the steps are iterated on all of the sub-bands the HFB is uniform, otherwise it is non-uniform.

Figure 6:
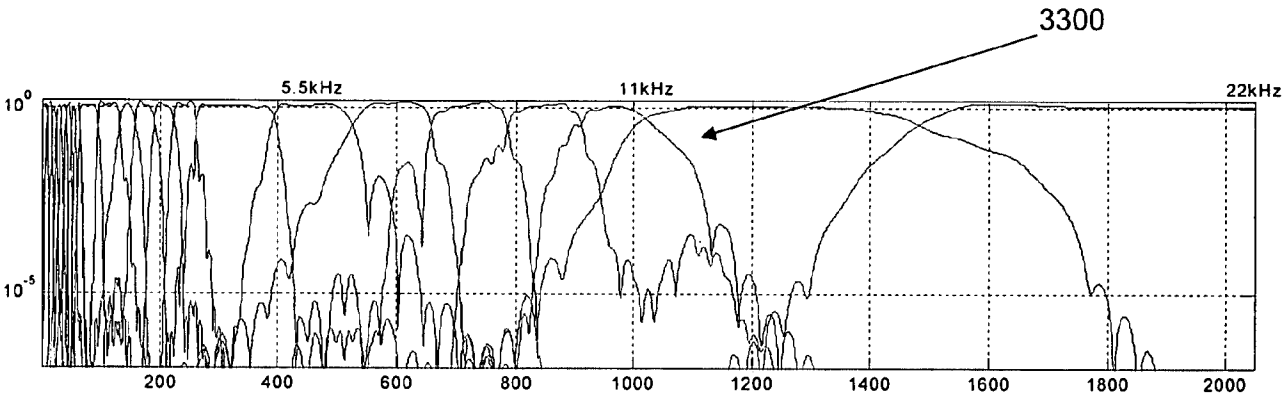
FIG. 6 is a plot of the frequency response of hierarchical filterbank.

The frequency response 3300 plot of an implementation of the filterbank of FIG. 3 and described above is shown in FIG. 6 in which N=128, Mi=16 and P=4, and the steps are iterated on the lowest two sub-bands at each stage.

The potential applications for this hierarchical filterbank go beyond audio, to processing of video and other types of signals (e.g. seismic, medical, other time-series signals). Video coding and compression have similar requirements for time/frequency decomposition, and the arbitrary nature of the decomposition provided by the Hierarchical Filterbank may have significant advantages over current state-of-the-art techniques based on Discrete Cosine Transform and Wavelet decomposition. The filterbank may also be applied in analyzing and processing seismic or mechanical measurements, biomedical signal processing, analysis and processing of natural or physiological signals, speech, or other time-series signals. Frequency domain information can be extracted from the transform coefficients produced at each iteration at successively lower frequency resolutions. Likewise time domain information can be extracted from the time-domain sub-band samples produced at each iteration at successively finer time scales.

Hierarchical Filterbank: Uniformly Spaced Sub-Bands

FIG. 7 shows a block diagram of an exemplary embodiment of the Hierarchical Filterbank 3900, which implements a uniformly spaced sub-band filterbank. For a uniform filterbank $M_i$=M=N/(2*P). The decomposition of the input signal into sub-band signals 3914 is described as follows:

1. Input time samples 3902 are windowed in N-point, 50% overlapping frames 3904.
2. A N-point MDCT 3906 is performed on each frame.
3. The resulting MDCT coefficients are grouped in P groups 3908 of M coefficients in each group.
4. A (2*M)-point IMDCT 3910 is performed on each group to form (2*M) sub-band time samples 3911.
5. The resulting time samples 3911 are windowed in (2*M)-point, 50% overlapping frames and overlap-added (OLA) 3912 to form M time samples in each sub-band 3914.

In an exemplary implementation, N=256, P=32, and M=4. Note that different transform sizes and sub-band groupings represented by different choices for N, P, and M can also be employed to achieve a desired time/frequency decomposition.

Hierarchical Filterbank: Non-Uniformly Spaced Sub-Bands

Figure 8A:
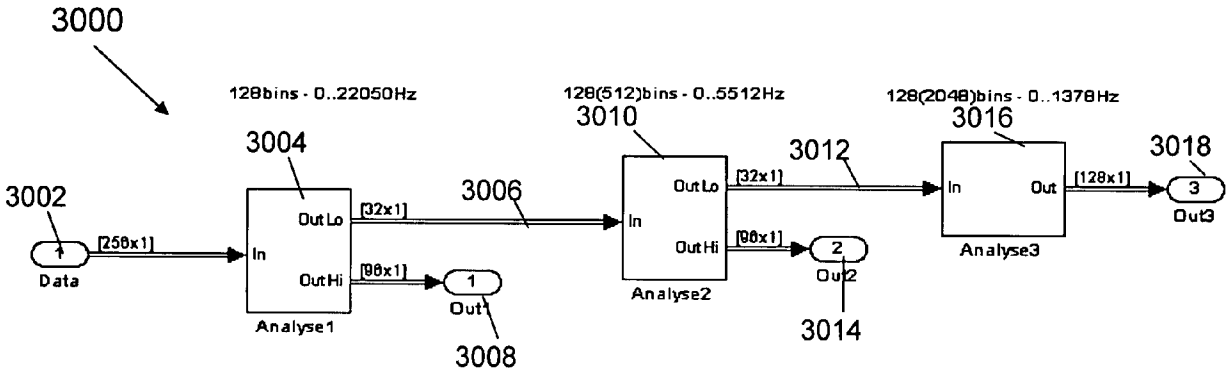
FIGS. 8*a* and 8*b* are a simplified block diagram of a 3-stage hierarchical filterbank and a more detailed block diagram of a single stage.
Figure 8B:
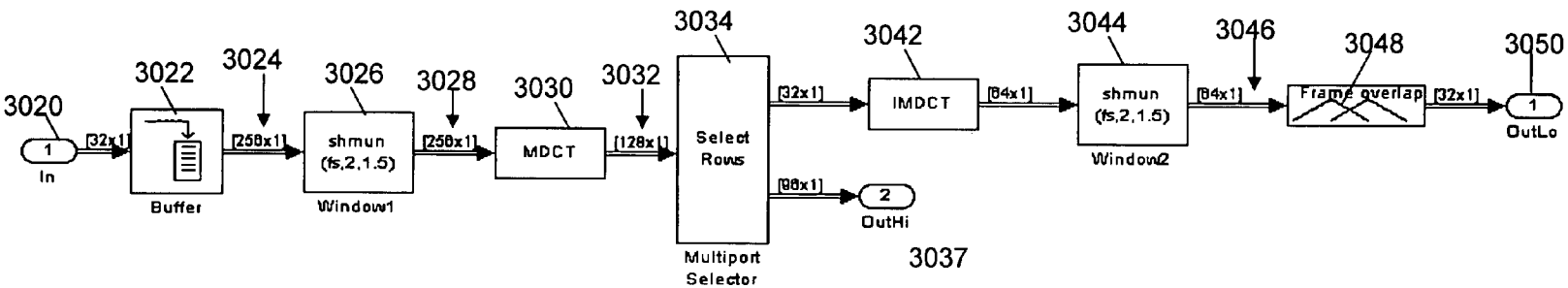

Another embodiment of a Hierarchical Filterbank 3000 is shown in FIGS. 8*a* and 8*b*. In this embodiment, some of the filterbank stages are incomplete to produce a transform with three different frequency ranges with the transform coefficients representing a different frequency resolution in each range. The time domain signal is decomposed into these transform coefficients using a series of cascaded single-element filterbanks. The detailed filterbank element may be iterated a number of times to produce a desired time/frequency decomposition. Note that the numbers for buffer sizes, transform sizes and window sizes, and the use of the MDCT/IMDCT for the transform are for one exemplary embodiment only and do not limit the scope of the present invention. Other buffer window and transform sizes and other transform types may also be used. In general, the $M_i$ differ from each other but satisfy the constraint that the sum of the $M_i$ equals N/2.

As shown in FIG. 8*b*, a single filterbank element buffers 3022 input samples 3020 to form buffers of 256 samples 3024, which are windowed 3026 by multiplying the samples by a 256-sample window function. The windowed samples 3028 are transformed via a 256-point MDCT 3030 to form 128 transform coefficients 3032. Of these 128 coefficients, the 96 highest frequency coefficients are selected 3034 for output 3037 and are not further processed. The 32 lowest frequency coefficients are then inverse transformed 3042 to produce 64 time domain samples, which are then windowed 3044 into samples 3046 and overlap-added 3048 with the previous output frame to produce 32 output samples 3050.

In the example shown in FIG. 8*a*, the filterbank is composed of one filterbank element 3004 iterated once with an input buffer size of 256 samples followed by one filterbank element 3010 also iterated with an input buffer size of 256 samples. The last stage 3016 represents an abbreviated single filterbank element and is composed of the buffering 3022, windowing 3026, and MDCT 3030 steps only to output 128 frequency domain coefficients representing the lowest frequency range of 0-1378 Hz.

Thus, assuming an input 3002 with a sample rate of 44100 Hz, the filterbank shown produces 96 coefficients representing the frequency range 5513 to 22050 Hz at "Out1" 3008, 96 coefficients representing the frequency range 1379 to 5512 Hz at "Out2" 3014, and 128 coefficients representing the frequency range 0 to 1378 Hz at "Out3" 3018, It should be noted that the use of MDCT/IMDCT for the frequency transform/inverse transform are exemplary and other time/frequency transformations can be applied as part of the present invention. Other values for the transform sizes are possible, and other decompositions are possible with this approach, by selectively expanding any branch in the hierarchy described above.

Multichannel Joint Coding of Tonal and Residual Components

The Tone Selector 103 in FIG. 1 takes as input, data from the Mask Calculator 101 and the tone list from Multi-Order Tone Extractor 102. The Tone Selector 103 first sorts the tone list by relative power over the masking level from Mask Calculator 101, forming an ordering by psychoacoustic importance. The formula employed is given by:

$$P_k = A_k \cdot \frac{\sum_{i=0}^{l-1}\left(1-\cos\left(\frac{\pi(2i+1)}{l}\right)\right)}{\sqrt{M_{i,k}}}$$

where:

$A_k$=spectral line amplitude $M_{i,k}$=masking level for k's spectral line in i's mask sub-frame l=length of base function in terms of mask sub-frames The summation is performed over the sub-frames where the spectral component has non-zero value.

Tone Selector 103 then uses an iterative process to determine which tonal components from the sorted tone list for the frame will fit into the bit stream. In stereo or multichannel audio signals, where the amplitude of a tone is about the same in more than one channel, only the full amplitude and phase is stored in the primary channel; the primary channel being the channel with the highest amplitude for the tonal component. Other channels having similar tonal characteristics store the difference from the primary channel.

The data for each transform size encompasses a number of sub-frames, the smallest transform size covering 2 sub-frames; the second 4 sub-frames; the third 8 sub-frames; the fourth 16 sub-frames; and the fifth 32 sub-frames. There are 16 sub-frames to 1 frame. Tone data is grouped by size of the transform in which the tone information was found. For each transform size, the following tonal component data is quantized, entropy-encoded and placed into the bit stream: entropy-coded sub-frame position, entropy-coded spectral position, entropy-coded quantized amplitude, and quantized phase.

Figure 9:
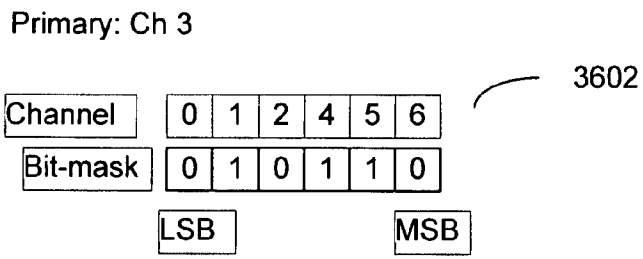
FIG. 9 is a bit mask for extending differential coding of tonal components to multichannel audio.

In the case of multichannel audio, for each tonal component, one channel is selected as the primary channel. The determination of which channel should be the primary channel may be fixed or may be made based on the signal characteristics or perceptual criteria. The channel number of the primary channel and its amplitude and phase are stored in the bit stream. As shown in FIG. 9, a bit-mask 3602 is stored which indicates which of the other channels include the indicated tonal component, and should therefore be coded as secondary channels. The difference between the primary and secondary amplitudes and phases are then entropy-coded and stored for each secondary channel in which the tonal component is present. This particular example assumes there are 7 channels, and the main channel is channel 3. The bit-mask 3602 indicates the presence of the tonal component on the secondary channels 1, 4, and 5. There is no bit used for the primary channel.

The output 4211 of Multi-Order Tone Extractor 102 is made up of frames of MDCT coefficients at one or more resolutions. The Tone Selector 103 determines which tonal components can be retained for insertion into the bit stream output frame by Code String Generator 108, based on their relevance to decoded signal quality. Those tonal components determined not to fit in the frame are output 110 to the Local Decoder 104. The Local Decoder 104 takes the output 110 of the Tone Selector 103 and synthesizes all tonal components by adding each tonal component scaled with synthesis coefficients 2000 from a lookup table (FIG. 20) to produce frames of MDCT coefficients (See FIG. 16). These coefficients are added to the output 111 of Multi-Order Tone Extractor 102 in the Combiner 105 to produce a residual signal 113 in the MDCT resolution of the last iteration of the hierarchical filterbank.

Figure 10:
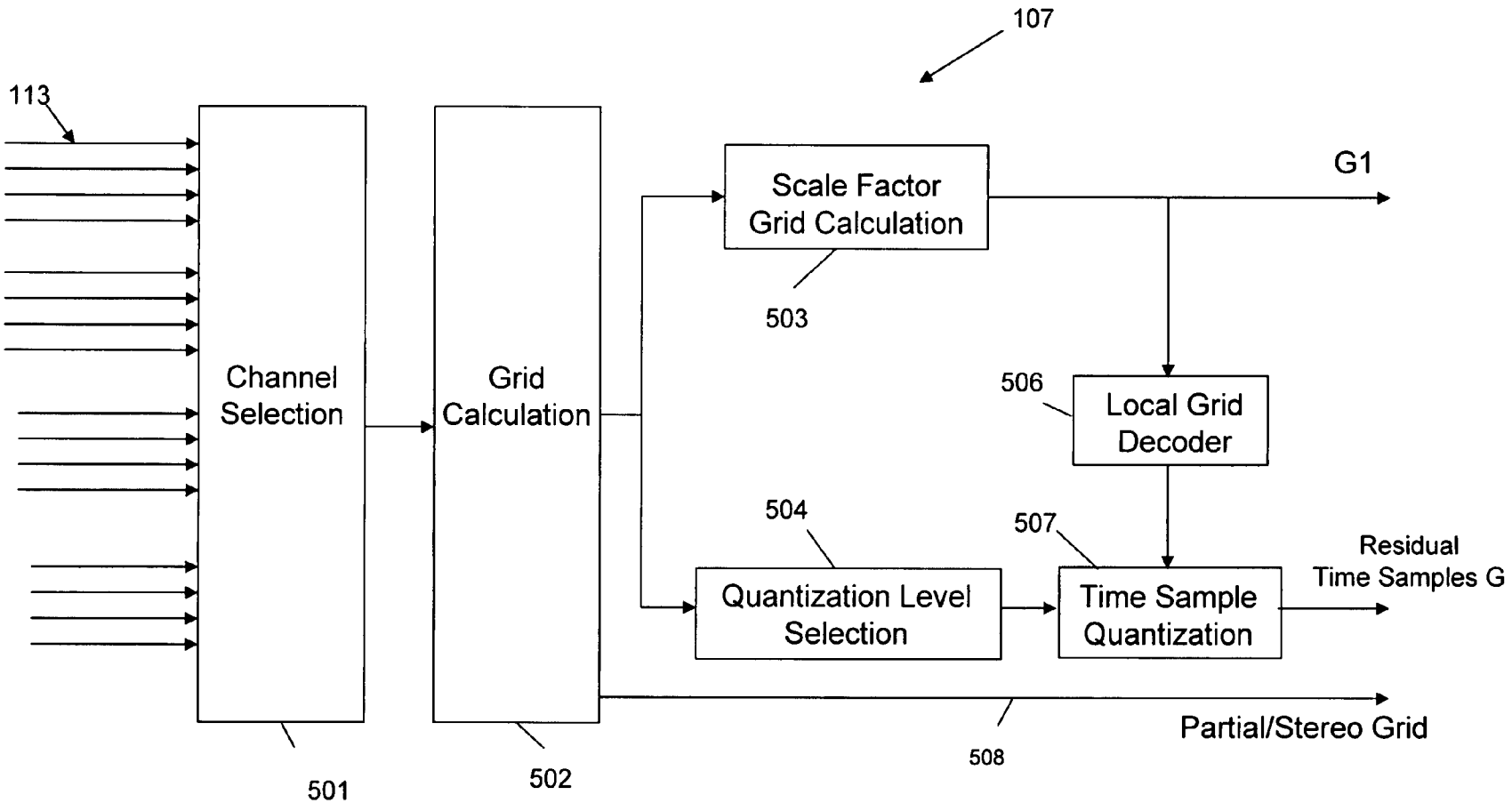
FIG. 10 depicts the detailed embodiment of the residual encoder used in an embodiment of the encoder of the present invention.

As shown in FIG. 10, the residual signal 113 for each channel is passed to the Residual Encoder 107 as the MDCT coefficients 3908 of the hierarchical filterbank 3900, prior to the steps of windowing and overlap add 3904 and IMDCT 3910 shown in FIG. 7. The subsequent steps of IMDCT 3910, windowing and overlap-add 3912 are performed to produce 32 equally-spaced critically sampled frequency sub-bands 3914 in the time domain for each channel. The 32 subbands, which make-up the time-sample components, are referred to as grid G. Note that other embodiments of the hierarchical filterbank could be used in an encoder to implement different time/frequency decompositions than the one outlined above and other transforms could be used to extract tonal components. If a hierarchical filterbank is not used to extract tonal components, another form of filterbank can be used to extract the subbands but at a higher computational burden.

Figure 11:
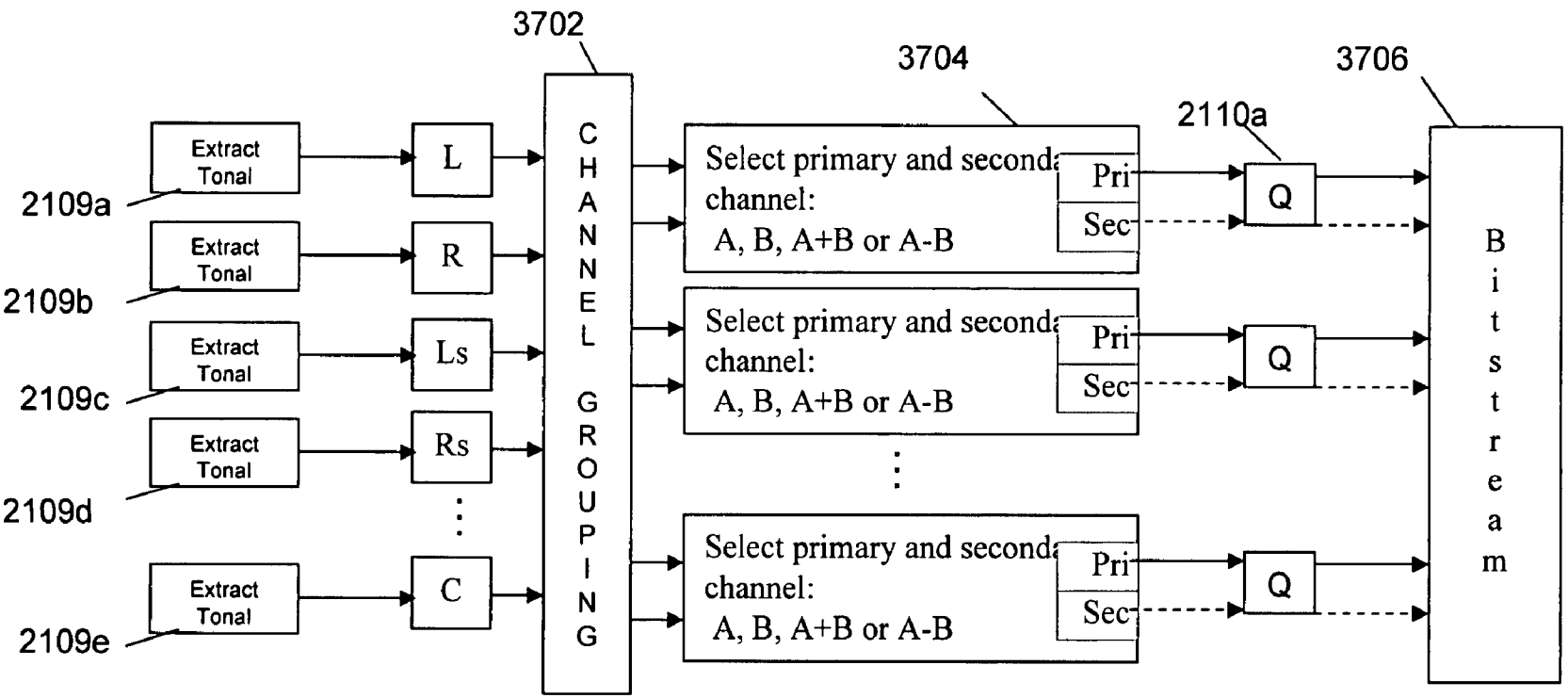
FIG. 11 is a block diagram for joint channel coding for multichannel audio.

For stereo or multichannel audio, several calculations are made in Channel Selection block 501 to determine the primary and secondary channel for encoding tonal components, as well as the method for encoding tonal components (for example, Left-Right, or Middle-Side). As shown in FIG. 11, a channel grouping process 3702 first determines which of the multiple channels may be jointly coded and all channels are formed into groups with the last group possibly being incomplete. The groupings are determined by perceptual criteria of a listener and coding efficiency, and channel groups may be constructed of combinations of more than two channels (for example, a 5-channel signal composed of L, R, Ls, Rs and C channels may be grouped as {L,R}, {Ls, Rs}, {L+R, C}. The channel groups are then ordered as Primary and Secondary channels. In an exemplary multichannel embodiment, the selection of the primary channel is made based on the relative power of the channels over the frame. The following equations define the relative powers:

$$P_l = \sum_{i=0}^{15} L_i^2 \quad P_r = \sum_{i=0}^{15} R_i^2 \quad P_m = \sum_{i=0}^{15} (L_i + R_i)^2 \quad P_s = \sum_{i=0}^{15} (L_i - R_i)^2$$

The grouping mode is also determined as shown in step 3704 of FIG. 11. The tonal components may be encoded as Left-Right or Middle-Side representation, or the output of this step may result in a single primary channel only as shown by the dotted lines. In Left-Right representation, the channel with the highest power for the sub-band is considered the primary and a single bit in the bit stream 3706 for the sub-band is set if the right channel is the channel of highest power. Middle-Side encoding is used for a sub-band if the following condition is met for the sub-band:

$$P_m > 2 \cdot P_s$$

For multichannel signals, the above is performed for each channel group.

For a stereo signal, Grid Calculation 502 provides a stereo panning grid in which stereo panning can roughly be reconstructed and applied to the residual signal. The stereo grid is 4 sub-bands by 4 time intervals, each sub-band in the stereo grid covers 4 sub-bands and 32 samples from the output of Filter Bank 500, starting with frequency bands above 3 k Hz. Other grid sizes, frequency sub-bands covered, and time divisions could be chosen. Values in the cells of the stereo grid are the ratio of the power of the given channel to that of the primary channel, for the range of values covered by the cell. The ratio is then quantized to the same table as that used to encode tonal components. For multichannel signals, the above stereo grid is calculated for each channel group.

For multichannel signals, Grid Calculation 502 provides multiple scale factor grids, one per each channel group, that are inserted into the bit stream in order of their psychoacoustic importance in the spatial domain. The ratio of the power of the given channel to the primary channel for each group of 4 sub-bands by 32 samples is calculated. This ratio is then quantized and this quantized value plus logarithm sign of the power ratio is inserted into the bit stream.

Scale Factor Grid Calculation 503 calculates grid G1, which is placed in the bit stream. The method for calculating G1 is now described. G0 is first derived from G. G0 contains all 32 sub-bands but only half the time resolution of G. The contents of the cells in G0 are quantized values of the maximum of two neighboring values of a given sub-band from G. Quantization (referred to in the following equations as Quantize) is performed using the same modified logarithmic quantization table as was used to encode the tonal components in the Multi-Order Tone Extractor 102. Each cell in G0 is thus determined by:

$$G0_{m,n} = \text{Quantize}(\text{Maximum}(G_{m,2n}, G_{m,2n+1}))\ n \in [0 \ldots 63]$$

where:

m is the sub-band number n is the G0's column number

G1 is derived from G0. G1 has 11 overlapping sub-bands and ⅛ the time resolution of G0, forming a grid 11×8 in dimension. Each cell in G1 is quantized using the same table as used for tonal components and found using the following formula:

$$G1_{m,n} = \text{Quantize}\left(\sum_{l=0}^{31}\left(W_l \cdot \sqrt{\sum_{i=8n}^{8n+7} G_{l,i}^2}\right)\right) \text{where:}$$

$W_l$ is a weight value obtained from the Table 1 in FIG. 19.

G0 is recalculated from G1 in Local Grid Decoder 506. In Time Sample Quantization Block 507, output time samples ("time-sample components") are extracted from the hierarchical filterbank (Grid G), which pass through Quantization Level Selection Block 504, scaled by dividing the time-sample components by the respective values in the recalculated G0 from Local Grid Decoder 506 and quantized to the number of quantization levels, as a function of sub-band, determined by quantization level selection block 504. These quantized time samples are then placed into the encoded bit stream along with the quantized grid G1. In all cases, a model reflecting the psychoacoustic importance of these components is used to determine priority for the bit stream storage operation.

In an additional enhancement step to improve the coding gain for some signals, grids including G, G1 and partial grids may be further processed by applying a two-dimensional Discrete Cosine Transform (DCT) prior to quantization and coding. The corresponding Inverse DCT is applied at the decoder following inverse quantization to reconstruct the original grids.

Scalable Bit Stream and Scaling Mechanism

Typically, each frame of the master bit stream will include (a) a plurality of quantized tonal components representing frequency domain content at different frequency resolutions of the input signal, b) quantized residual time-sample components representing the time-domain residual formed from the difference between the reconstructed tonal components and the input signal, and c) scale factor grids representing the signal energies of the residual signal, which span a frequency range of the input signal. For a multichannel signal each frame may also contain d) partial grids representing the signal energy ratios of the residual signal channels within channel groups and e) a bitmask for each primary specifying the joint-encoding of secondary channels for tonal components. Usually a portion of the available data rate in each frame is allocated from the tonal components (a) and a portion is allocated for the residual components (b,c). However, in some cases all of the available rate may be allocated to encode the tonal components. Alternately, all of the available rate may be allocated to encode the residual components. In extreme cases, only the scale factor grids may be encoded, in which case the decoder uses a noise signal to reconstruct an output signal. In most any actual application, the scaled bit stream will include at least some frames that contain tonal components and some frames that include scale factor grids.

Figure 12:
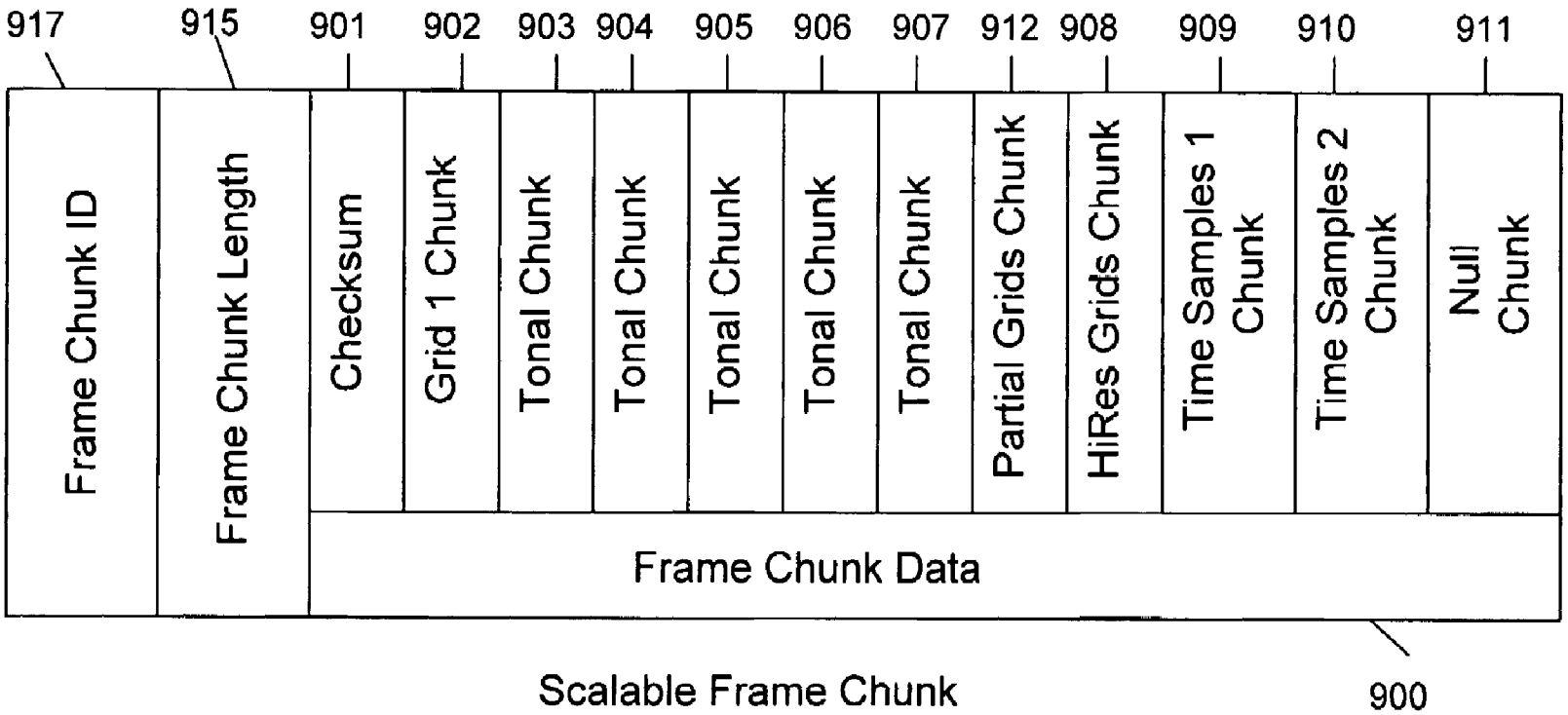
FIG. 12 schematically represents a scalable frame of data produced by the scalable bit stream encoder of the present invention.

The structure and order of components placed in the master bit stream, as defined by the present invention, provides for wide bit range, fined grained, bit stream scalability. It is this structure and order that allows the bit stream to be smoothly scaled by external mechanisms. FIG. 12 depicts the structure and order of components based on the audio compression codec of FIG. 1 that decomposes the original bit stream into a particular set of psychoacoustically relevant components. The scalable bit stream used in this example is made up of a number of Resource Interchange File Format, or RIFF, data structures called "chunks", although other data structures can be used. This file format which is well known by those skilled in the art, allows for identification of the type of data carried by a chunk as well as the amount of data carried by a chunk. Note that any bit stream format that carries information regarding the amount and type of data carried in its defined bit stream data structures can be used to practice the present invention.

FIG. 12 shows the layout of a scalable data rate frame chunk 900, along with sub-chunks 902, 903, 904, 905, 906, 906, 907, 908, 909, 910 and 912, which comprise the psychoacoustic data being carried within frame chunk 900. Although FIG. 12 only depicts chunk ID and chunk length for the frame chunk, sub-chunk ID and sub-chunk length data is included within each sub-chunk. FIG. 12 shows the order of sub-chunks in a frame of the scalable bit stream. These sub-chunks contain the psychoacoustic components produced by the scalable bit stream encoder, with a unique sub-chunk used for each sub-domain of the encoded bit stream. In addition to the sub-chunks being arranged in psychoacoustic importance, either by a priori decision or calculation, the components within the sub-chunks are also arranged in psychoacoustic importance. Null Chunk 911, which is the last chunk in the frame, is used to pad chunks in the case where the frame is required to be a constant or specific size. Therefore Chunk 911 has no psychoacoustic relevance and is the least important psychoacoustic chunk. Time Samples 2 Chunk 910 appears on the right hand side of the figure and the most important psychoacoustic chunk, Grid 1 Chunk 902 appears on the left hand side of the figure. By operating to first remove data from the least psychoacoustically relevant chunk at the end of the bit stream, Chunk 910 and working towards removing greater and greater psychoacoustically relevant components toward the beginning of the bit stream, Chunk 902, the highest quality possible is maintained for each successive reduction in data rate. It should be noted that the highest data rate, along with the highest audio quality, able to be supported by the bit stream, is defined at encode time. However, the lowest data rate after scaling is defined by the level of audio quality that is acceptable for use by an application or by the rate constraint placed on the channel or media.

Each psychoacoustic component removed does not utilize the same number of bits. The scaling resolution for the current implementation of the present invention ranges from 1 bit for components of lowest psychoacoustic importance to 32 bits for those components of highest psychoacoustic importance. The mechanism for scaling the bit stream does not need to remove entire chunks at a time. As previously mentioned, components within each chunk are arranged so that the most psychoacoustically important data is placed at the beginning of the chunk. For this reason, components can be removed from the end of the chunk, one component at a time, by a scaling mechanism while maintaining the best audio quality possible with each removed component. In one embodiment of the present invention, entire components are eliminated by the scaling mechanism, while in other embodiments, some or all of the components may be eliminated. The scaling mechanism removes components within a chunk as required, updating the Chunk Length field of the particular chunk from which the components were removed, the Frame Chunk Length 915 and the Frame Checksum 901. As will be seen from the detailed discussion of the exemplary embodiments of the present invention, with updated Chunk Length for each chuck scaled, as well as updated Frame Chunk Length and Frame Checksum information available to the decoder, the decoder can properly process the scaled bit stream, and automatically produce a fixed sample rate audio output signal for delivery to the DAC, even though there are chunks within the bit stream that are missing components, as well as chunks that are completely missing from the bit stream.

Scalable Bit Stream Decoder for a Residual Coding Topology

Figure 13:
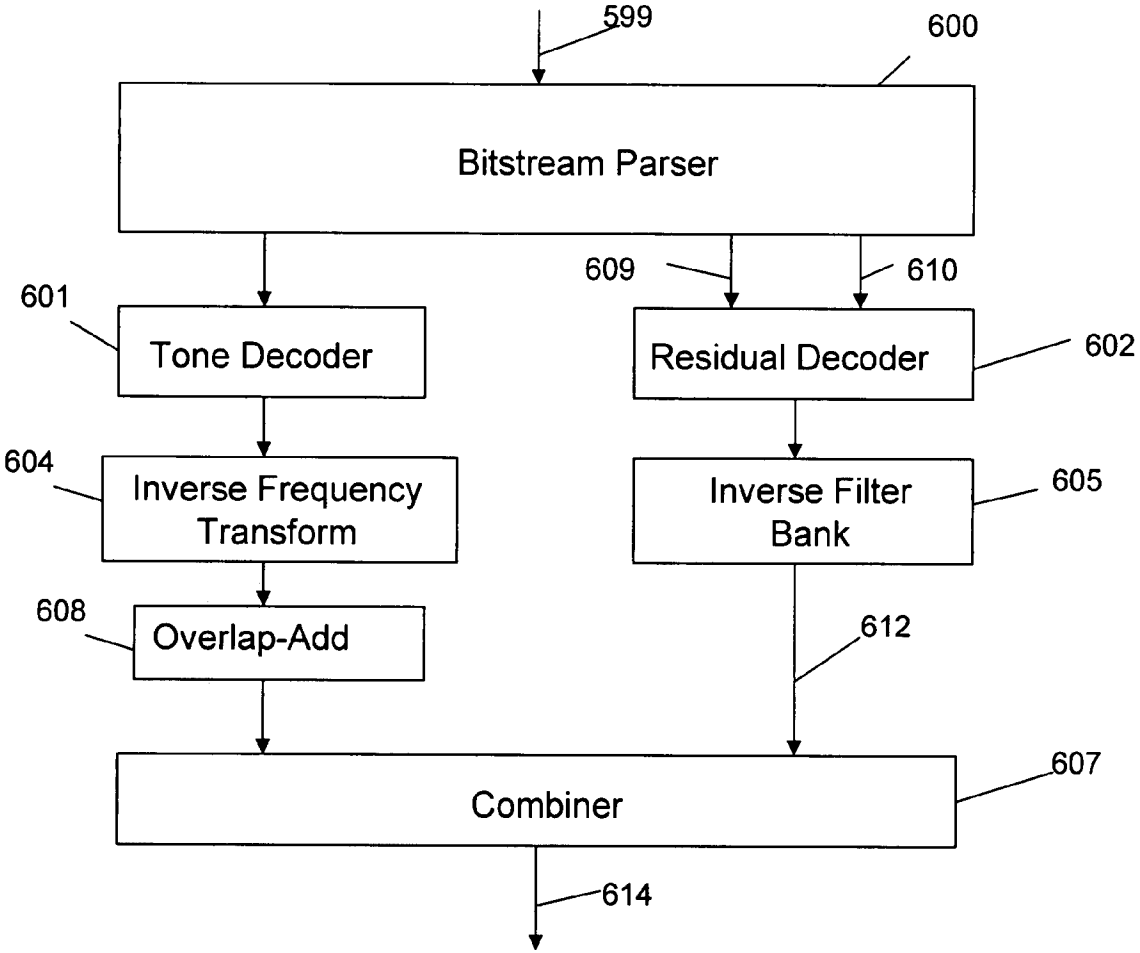
FIG. 13 shows the detailed block diagram of one implementation of the decoder used in the present invention.

FIG. 13 shows the block diagram for the decoder. The Bit stream Parser 600 reads initial side information consisting of: the sample rate in Hertz of the encoded signal before encoding, the number of channels of audio, the original data rate of the stream, and the encoded data rate. This initial side information allows it to reconstruct the full data rate of the original signal. Further components in bit stream 599 are parsed by the Bit stream Parser 600 and passed to the appropriate decoding element: Tone Decoder 601 or Residual Decoder 602. Components decoded via the Tone Decoder 601 are processed through the Inverse Frequency Transform 604 which converts the signal back into the time domain. The Overlap-Add block 608 adds the values of the last half of the previously decoded frame to the values of the first half of the just decoded frame which is the output of Inverse Frequency Transform 604. Components which the Bit stream Parser 600 determines to be part of the residual decoding process are processed though the Residual Decoder 602. The output of the Residual Decoder 602, containing 32 frequency sub-bands represented in the time domain, is processed through the Inverse Filter Bank 605. Inverse Filter Bank 605 recombines the 32 sub-bands into one signal to be combined with the output of the Overlap-Add 608 in Combiner 607. The output of Combiner 607 is the decoded output signal 614.

To reduce computational burden, the Inverse Frequency Transform 604 and Inverse Filter Bank 605 which convert the signals back into the time domain can be implemented with an inverse Hierarchical Filterbank, which integrates these operations with the Combiner 607 to form decoded time domain output audio signal 614. The use of the hierarchical filterbank in the decoder is novel in the way in which the tonal components are combined with the residual in the hierarchical filterbank at the decoder. The residual signals are forward transformed using MDCTs in each sub-band, and then the tonal components are reconstructed and combined prior to the last stage IMDCT. The multi-resolution approach could be generalized for other applications (e.g. multiple levels, different decompositions would still be covered by this aspect of the invention).

Inverse Hierarchical Filterbank

Figure 15:
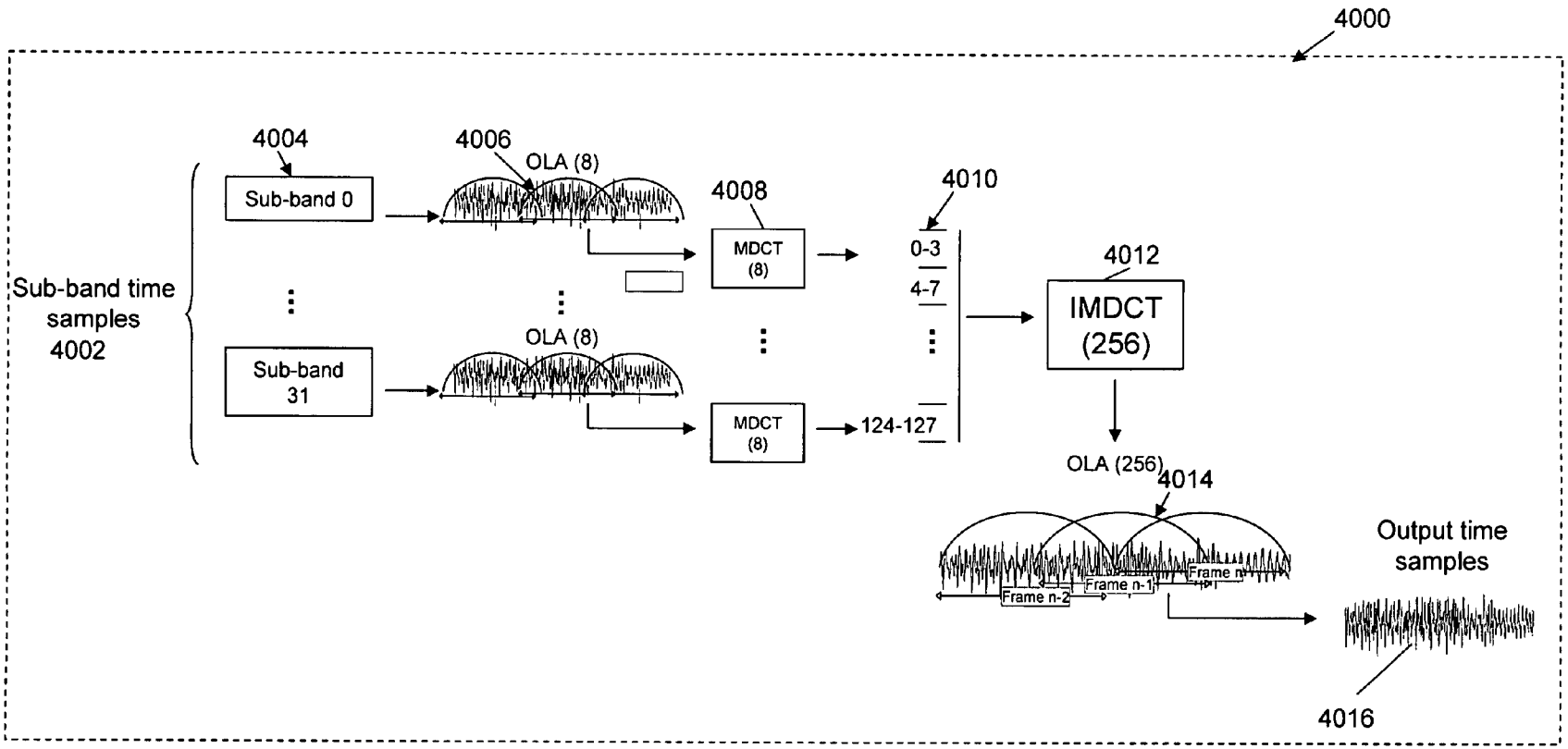
FIG. 15 is a block diagram of an exemplary implementation of an inverse hierarchical filterbank.

In order to reduce complexity of the decoder, the hierarchical filterbank may be used to combine the steps of Inverse Frequency Transform 604, Inverse Filterbank 605, Overlap-Add 608, and Combiner 607. As shown in FIG. 15, the output of the Residual Decoder 602 is passed to the first stage of the Inverse Hierarchical Filterbank 4000 while the output of the Tone Decoder 601 is added to the Residual samples in the higher frequency resolution stage prior to the final inverse transform 4010. The resulting inverse transformed samples are then overlap added to produce the linear output samples 4016.

Figure 18:
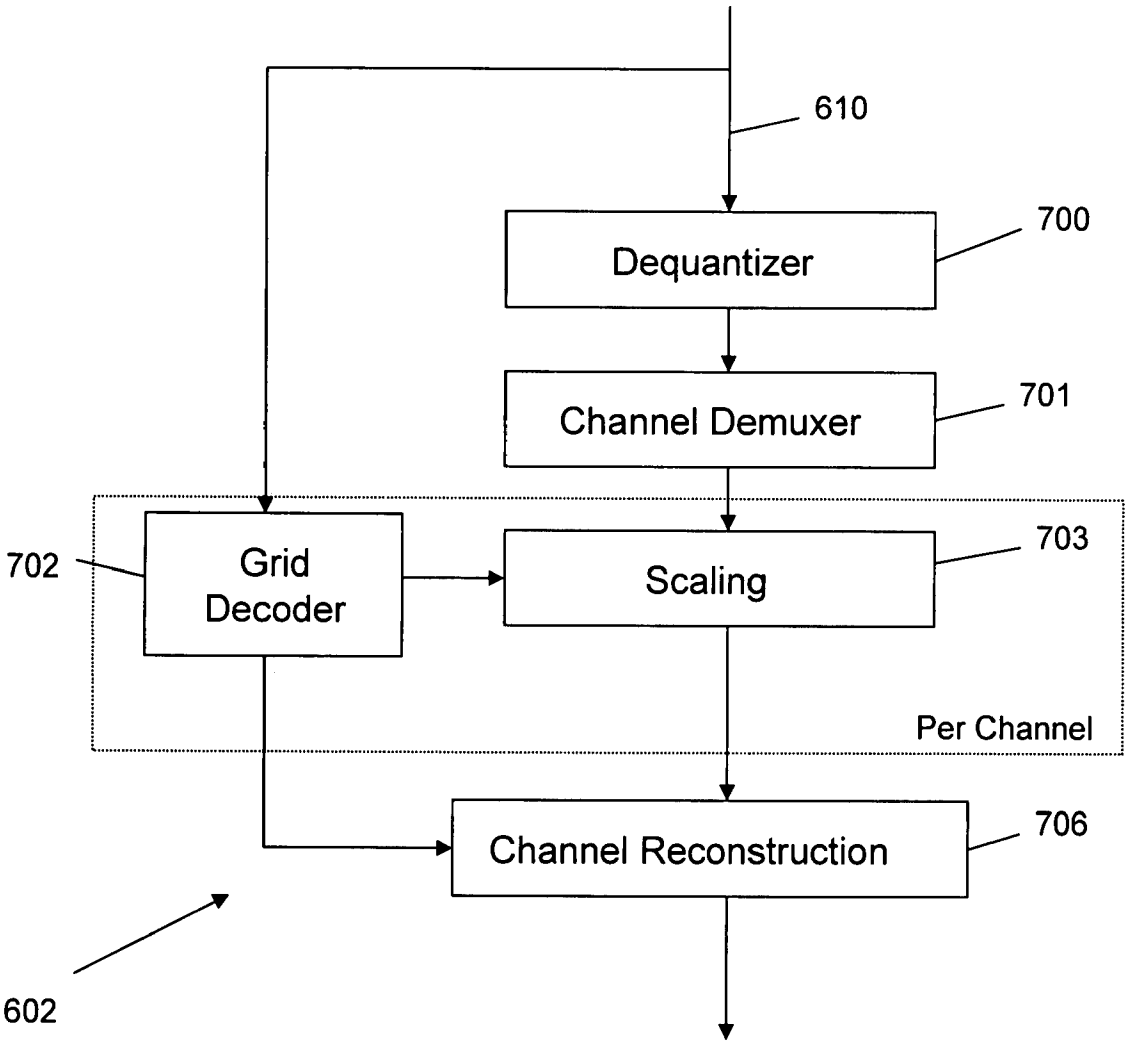
FIG. 18 is a detailed block diagram of the residual decoder.
Figure 22:
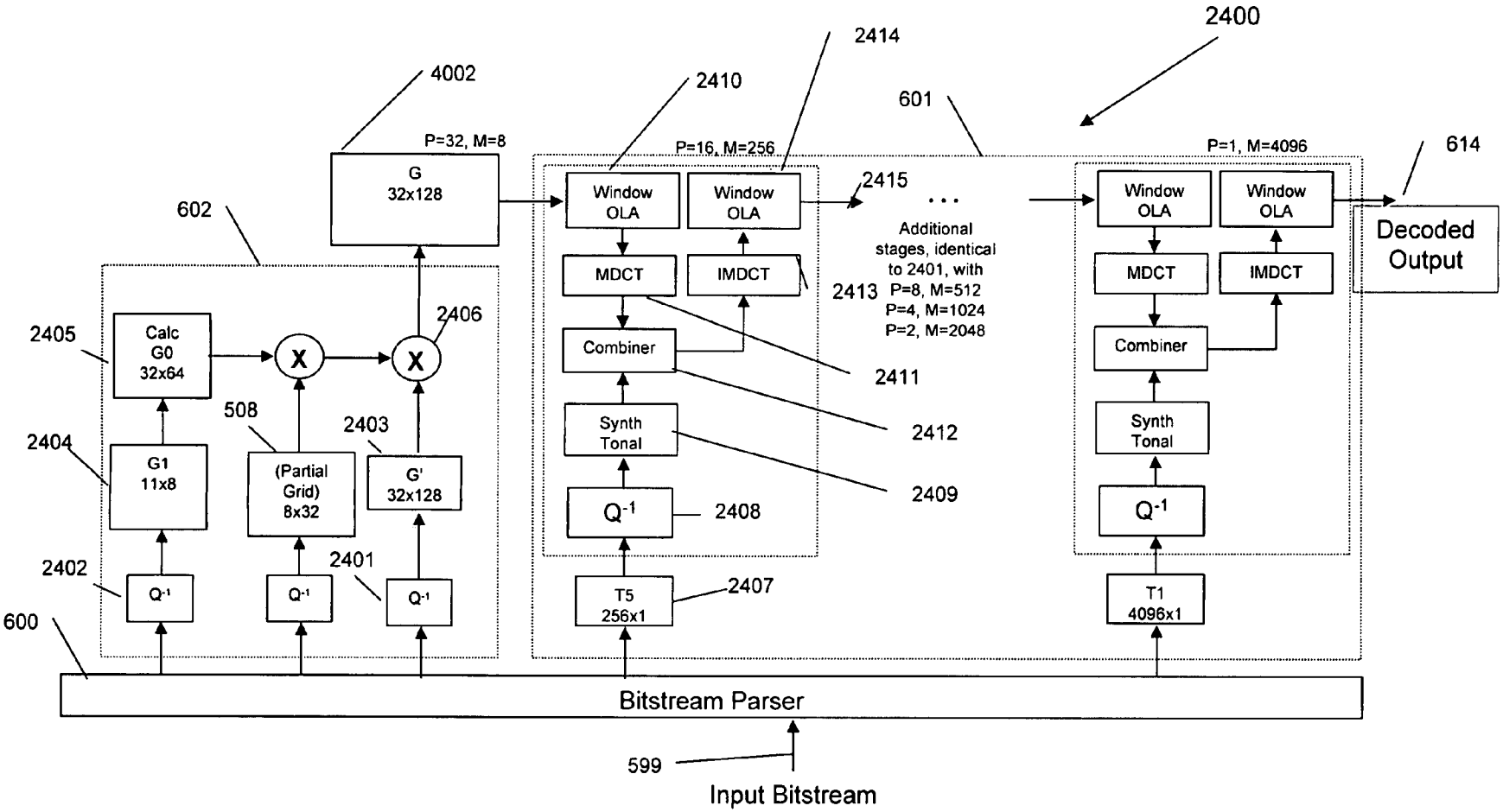

The overall operation of the decoder for a single channel using the HFB 2400 is shown in FIG. 22. The additional steps for multichannel decoding of the tones and residual signals are shown in FIGS. 10, 11 and 18. Quantized Grids G1 and G' are read from the bit stream 599 by Bit stream Parser 600. Residual decoder 602 inverse quantizes ($Q^{-1}$) 2401, 2402 Grids G' 2403 and G1 2404 and reconstructs Grid G0 2405 from Grid G1. Grid G0 is applied to Grid G' by multiplying 2406 corresponding elements in each grid to form the scaled Grid G, which consists of sub-band time samples 4002 which are input to the next stage in the hierarchical filterbank 2401. For a multichannel signal, partial grid 508 would be used to decode the secondary channels.

The tonal components (T5) 2407 at the lowest frequency resolution (P=16, M=256) are read from the bit stream by Bit stream Parser 600. Tone decoder 601 inverse quantizes 2408 and synthesizes 2409 the tonal component to produce P groups of M frequency domain coefficients.

Figure 16:
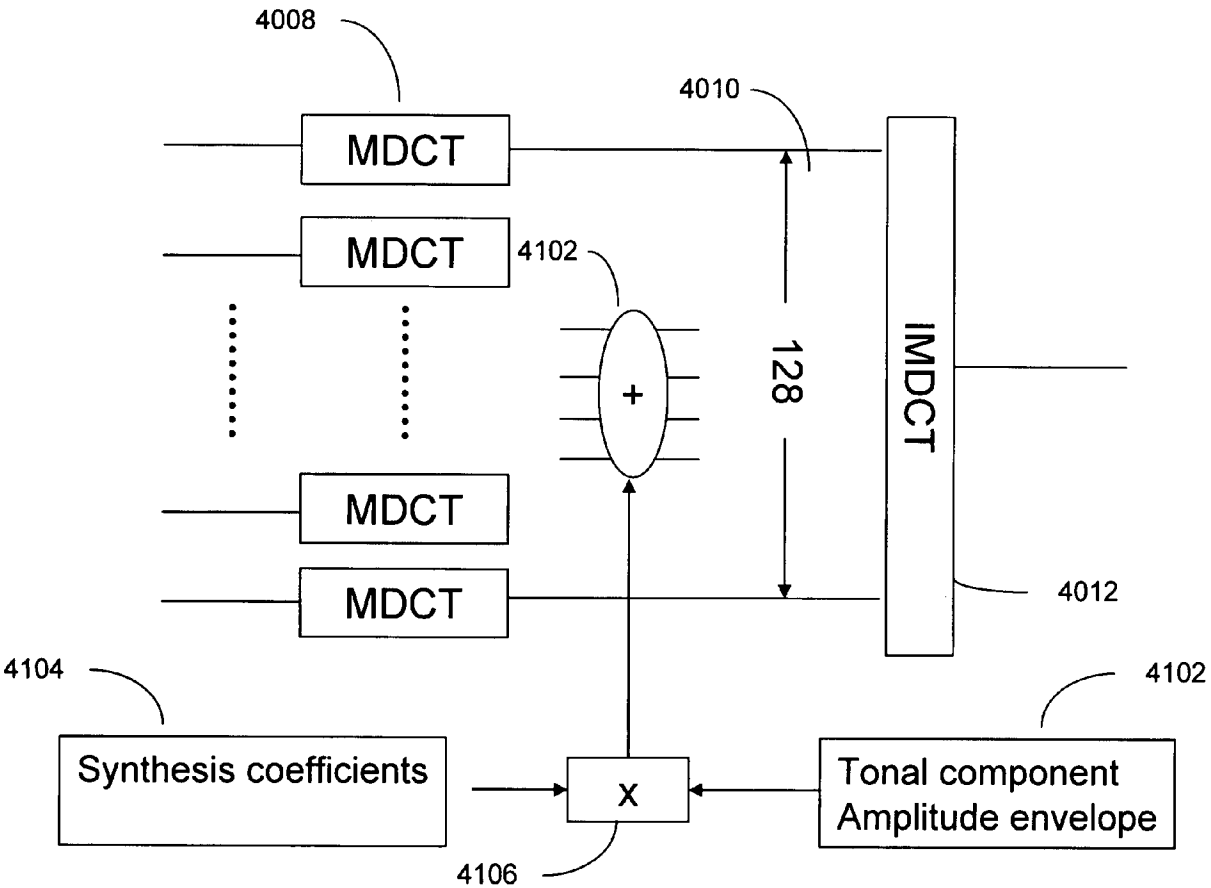
FIG. 16 is a block diagram of the combining of tonal and residual components using an inverse hierarchical filterbank in the decoder.

The Grid G time samples 4002 are windowed and overlap-added 2410 as shown in FIG. 15, then forward transformed by P (2*M)-point MDCTs 2411 to form P groups of M frequency domain coefficients which are then combined 2412 with the P groups of M frequency domain coefficients synthesized from the tonal components as shown in FIG. 16. The combined frequency domain coefficients are then concatenated and inverse transformed by a length-N IMDCT 2413, windowed and overlap-added 2414 to produce N output samples 2415 which are input to the next stage of the hierarchical filterbank.

The next lowest frequency resolution tonal components (T4) are read from the bit stream, and combined with the output of the previous stage of the hierarchical filterbank as described above, and then this iteration continues for P=8, 4, 2, 1 and M=512, 1024, 2048, and 4096 until all frequency components have been read from the bit stream, combined and reconstructed.

At the final stage of the decoder, the inverse transform produces N full-bandwidth time samples which are output as Decoded Output 614. The preceding values of P, M and N are for one exemplary embodiment only and do not limit the scope of the present invention. Other buffer, window and transform sizes and other transform types may also be used.

As described, the decoder anticipates receiving a frame that includes tonal components, time-sample components and scale factor grids. However, if one or more of these are missing from the scaled bit stream the decoder seamlessly reconstructs the decoded output. For example, if the frame includes only tonal components then the time-samples at 4002 are zero and no residual is combined 2403 with the synthesized tonal components in the first stage of the inverse HFB. If one or more of the tonal components T5, . . . T1 are missing, than a zero value is combined 2403 at that iteration. If the frame includes only the scale-factor grids, then the decoder substitutes a noise signal for Grid G to decode the output signal. As a result, the decoder can seamlessly reconstruct the decoded output signal as the composition of each frame of the scaled bit stream may change due to the content of the signal, changing data rate constraints, etc.

FIG. 16 shows in more detail how tonal components are combined within the Inverse Hierarchical Filterbank of FIG. 15. In this case, the sub-band residual signals 4004 are windowed and overlap-added 4006, forward transformed 4008 and the resulting coefficients from all sub-bands are grouped to form single frame 4010 of coefficients. Each tonal coefficient is then combined with the frame of residual coefficients by multiplying 4106 the tonal component amplitude envelope 4102 by a group of synthesis coefficients 4104 (normally provided by table lookup) and adding the results to the coefficients centered around the given tonal component frequency 4106. The addition of these tonal synthesis coefficients is performed on the spectral lines of the same frequency region over the full length of tonal component. After all tonal components are added in this way, the final IMDCT 4012 is performed and the results are windowed and overlap-added 4014 with the previous frame to produce the output time samples 4016.

Figure 14:
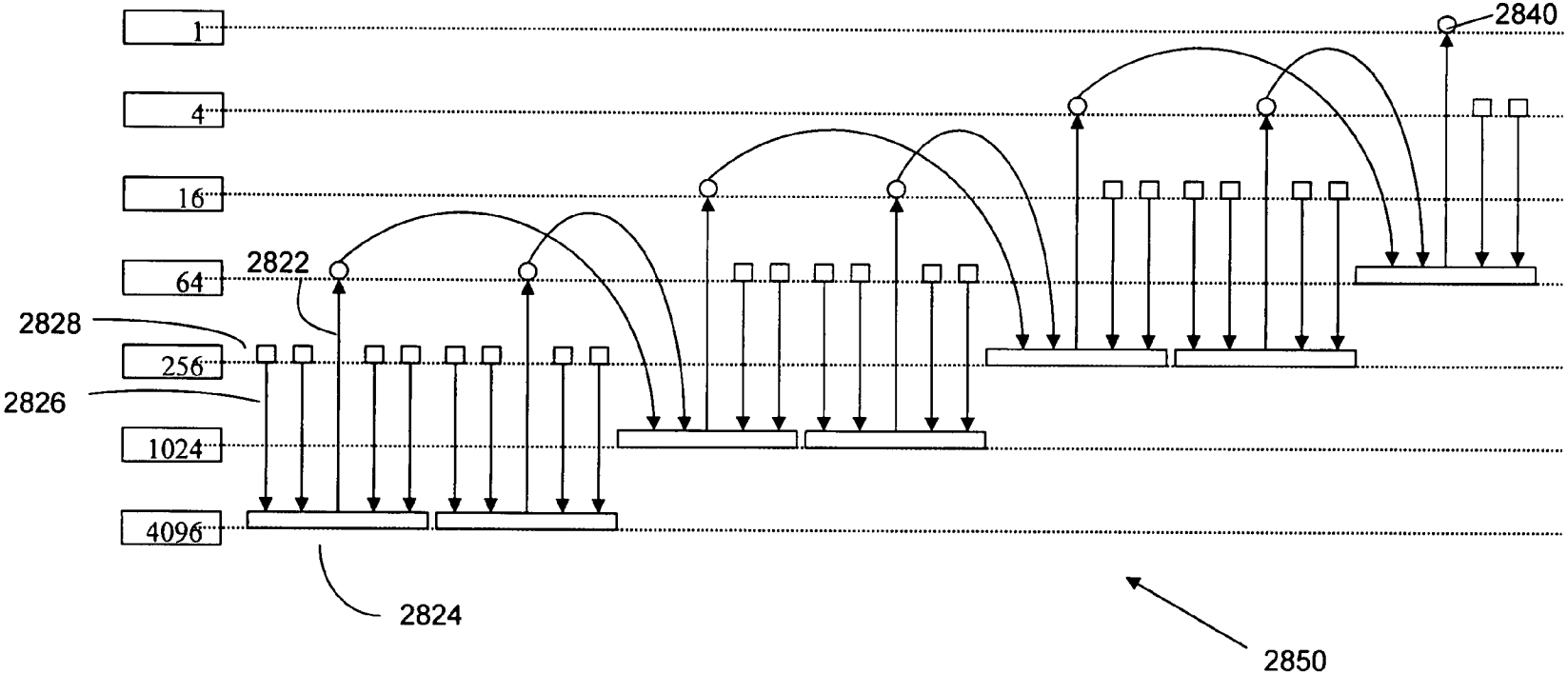
FIG. 14 is an illustration of an inverse hierarchical filterbank for reconstructing time-series data from both time-sample and frequency components in accordance with the present invention.

The general form of the Inverse Hierarchical Filterbank 2850 is shown in FIG. 14 which is compatible with the Hierarchical Filterbank shown in FIG. 3. Each input frame contains $M_i$ time samples in each of P sub-bands, such that the sum of the $M_i$ coefficients is N/2:

$$\sum_{i=1}^{P} M_i = N/2;$$

Figure 5B:
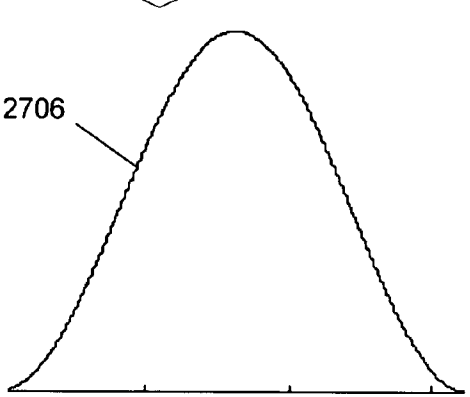
Figure 5C:
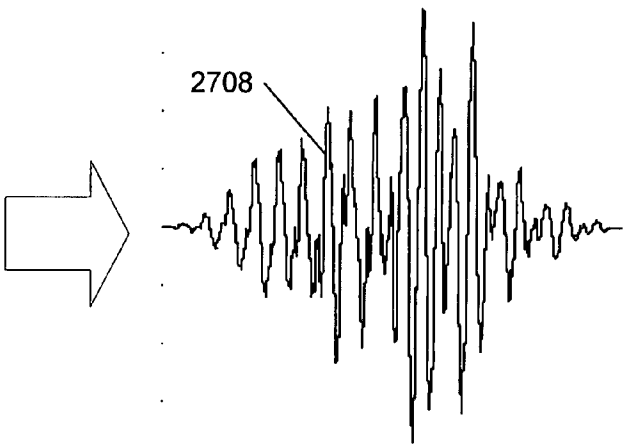

In FIG. 14, upward arrows represent an N-point IMDCT transform which takes N/2 MDCT coefficients and transforms them into N time-domain samples. Downward arrows represent an MDCT which takes N/4 samples within one sub-band and transforms them into N/8 MDCT coefficients. Each square represents one subband. Each rectangle represents N/2 MDCT coefficients. The following steps are shown in FIG. 14:

(a) In each sub-band, the $M_i$ previous samples are buffered and concatenated with the current $M_i$ samples to produce ($2*M_i$) new samples for each sub-band 2828;

(b) In each sub-band, the ($2*M_i$) sub-band samples are multiplied by a ($2*M_i$)-point window function 2706 (FIG. 5*a*-5*c*);

(c) A ($2*M_i$)-point transform (represented by the downward arrow 2826) is applied to produce $M_i$ transform coefficients for each subband;

(d) The $M_i$ transform coefficients for each subband are concatenated to form a single group 2824 of N/2 coefficients;

(e) An N-point Inverse Transform (represented by the upward arrow 2822) is applied to the concatenated coefficients to produce N samples;

(f) Each Frame of N samples 2704 is multiplied by an N-sample window function 2706 to produce N windowed samples 2708;

(g) The resulting windowed samples 2708 are overlap added to produce N/2 new output samples at the given sub-band level;

(h) The above steps are repeated at the current level and all subsequent levels until all sub-bands have been processed and the original time samples 2840 are reconstructed.

Inverse Hierarchical Filterbank: Uniformly Spaced Sub-Bands

FIG. 15 shows a block diagram of an exemplary embodiment of an Inverse Hierarchical Filterbank 4000 compatible with the forward filterbank shown in FIG. 7. The synthesis of the decoded output signal 4016 is described in more detail as follows:

1. Each input frame 4002 contains M time samples in each of P sub-bands.
2. Buffer each sub-band 4004, shift in M new samples, apply (2*M)-point window, 50% overlap-add (OLA) 4006 to produce M new sub-band samples.
3. A (2*M)-point MDCT 4008 performed within each sub-band to form M MDCT coefficients in each of P sub-bands.
4. The resulting MDCT coefficients are grouped to form single frame 4010 of (N/2) MDCT coefficients.
5. An N-point IMDCT 4012 performed on each frame
6. The IMDCT output is windowed in N-point, 50% overlapping frames and overlap-added 4014 to form N/2 new output samples 4016.

In an exemplary implementation, N=256, P=32, and M=4. Note that different transform sizes and sub-band groupings represented by different choices for N, P, and M can also be employed to achieve a desired time/frequency decomposition.

Inverse Hierarchical Filterbank: Non-Uniformly Spaced Sub-Bands

Figure 17A:
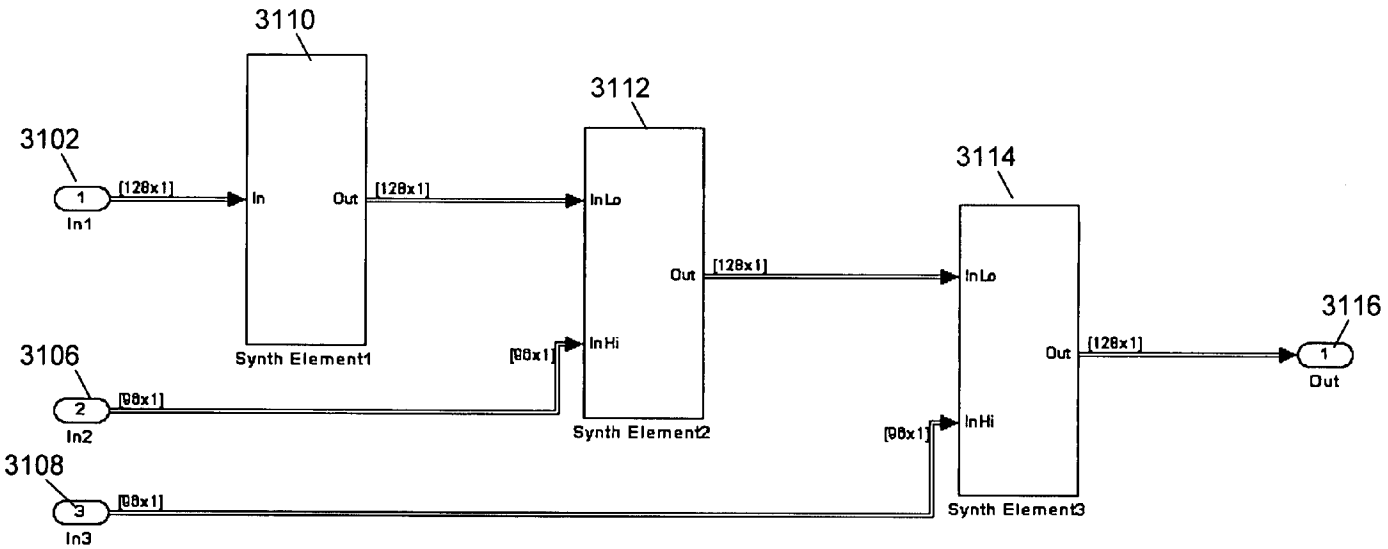
FIGS. 17*a* and 17*b* are a simplified block diagram of a 3-stage inverse hierarchical filterbank and a more detailed block diagram of a single stage.
Figure 17B:
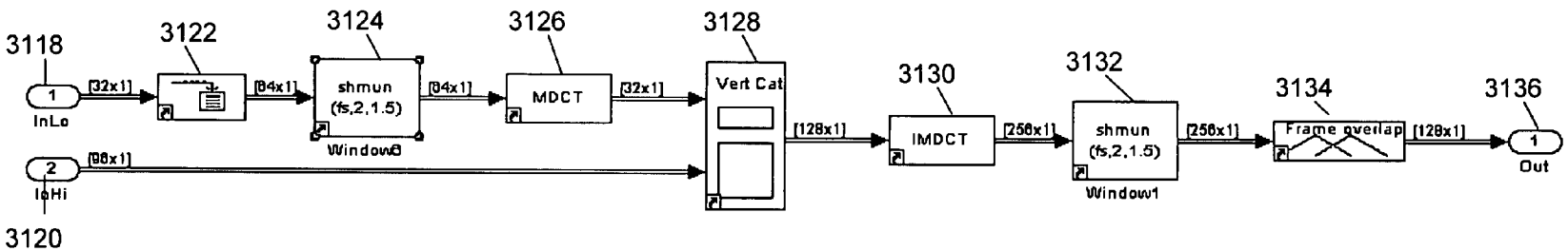

Another embodiment of the Inverse Hierarchical Filterbank is shown in FIG. 17*a-b*, which is compatible with the filterbank show in FIG. 8*a-b*. In this embodiment, some of the detailed filterbank elements are incomplete to produce a transform with three different frequency ranges with the transform coefficients representing a different frequency resolution in each range. The reconstruction of the time domain signal from these transform coefficients is described as follows:

In this case, the first synthesis element 3110 omits the steps of buffering 3122, windowing 3124, and the MDCT 3126 of the detailed element shown in FIG. 17*b*. Instead, the input 3102 forms a single set of coefficients which are inverse transformed 3130 to produce 256 time samples, which are windowed 3132 and overlap-added 3134 with the previous frame to produce the output 3136 of 128 new time samples for this stage.

The output of the first element 3110 and 96 coefficients 3106 are input to the second element 3112 and combined as shown in FIG. 17*b* to produce 128 time samples for input to the third element 3114 of the filterbank. The second element 3112 and third element 3114 in FIG. 17*a* implement the full detailed element of FIG. 17*b*, cascaded to produce 128 new time samples output from the filterbank 3116. Note that the buffer and transform sizes are provided as examples only, and other sizes may be used. In particular note that the buffering 3122 at the input to the detailed element may change to accommodate different input sizes depending on where it is used in the hierarchy of the general filterbank.

Further details regarding the decoder blocks will now be described.

Bit Stream Parser 600

The Bit stream Parser 600 reads IFF chunk information from the bit stream and passes elements of that information on to the appropriate decoder, Tone Decoder 601 or Residual Decoder 602. It is possible that the bit stream may have been scaled before reaching the decoder. Depending on the method of scaling employed, psychoacoustic data elements at the end of a chunk may be invalid due to missing bits. Tone Decoder 601 and Residual Decoder 602 appropriately ignore data found to be invalid at the end of a chunk. An alternative to Tone Decoder 601 and Residual Decoder 602 ignoring whole psychoacoustic data elements, when bits of the element are missing, is to have these decoders recover as much of the element as possible by reading in the bits that do exist and filling in the remaining missing bits with zeros, random patterns or patterns based on preceding psychoacoustic data elements. Although more computationally intensive, the use of data based on preceding psychoacoustic data elements is preferred because the resulting decoded audio can more closely match the original audio signal.

Tone Decoder 601

Tone information found by the Bit stream Parser 600 is processed via Tone Decoder 601. Re-synthesis of tonal components is performed using the hierarchical filterbank as previously described. Alternatively, an Inverse Fast Fourier Transform whose size is the same size as the smallest transform size which was used to extract the tonal components at the encoder can be used.

The following steps are performed for tonal decoding:

a) Initialize the frequency domain sub-frame with zero values
b) Re-synthesize the required portion of tonal components from the smallest transform size into the frequency domain sub-frame
c) Re-synthesize and add at the required positions, tonal components from the other four transform sizes into the same sub-frame. The re-synthesis of these other four transform sizes can occur in any order.

Tone Decoder 601 decodes the following values for each transform size grouping: quantized amplitude, quantized phase, spectral distance from the previous tonal component for the grouping, and the position of the component within the full frame. For multichannel signals, the secondary information is stored as differences from the primary channel values and needs to be restored to absolute values by adding the values obtained from the bit stream to the value obtained for the primary channel. For multichannel signals, per-channel 'presence' of the tonal component is also provided by the bit mask 3602 which is decoded from the bit stream. Further processing on secondary channels is done independently of the primary channel. If Tone Decoder 601 is not able to fully acquire the elements necessary to reconstruct a tone from the chunk, that tonal element is discarded. The quantized amplitude is dequantized using the inverse of the table used to quantize the value in the encoder. The quantized phase is dequantized using the inverse of the linear quantization used to quantize the phase in the encoder. The absolute frequency spectral position is determined by adding the difference value obtained from the bit stream to the previously decoded value. Defining Amplitude to be the dequantized amplitude, Phase to be the dequantized phase, and Freq to be the absolute frequency position, the following pseudo-code describes the re-synthesis of tonal components of the smallest transform size:

```
Re[Freq]+=Amplitude*sin(2*Pi*Phase/8);

Im[Freq]+=Amplitude*cos(2*Pi*Phase/8);

Re[Freq+1]+=Amplitude*sin(2*Pi*Phase/8);

Im[Freq+1]+=Amplitude*cos(2*Pi*Phase/8);
```

Re-synthesis of longer base functions are spread over more sub-frames therefore the amplitude and phase values need to be updated according to the frequency and length of the base function. The following pseudo-code describes how this is done:

```
xFreq = Freq >> (Group − 1);
CurrentPhase = Phase − 2 * (2 * xFreq + 1);
for(i = 0; i < length; i = i + 1)
{
    CurrentPhase += 2 * (2 * Freq + 1) / length;
    CurrentAmplitude = Amplitude * Envelope[Group][i];
    Re[i][xFreq] += CurrentAmplitude * sin( 2 * Pi *
    CurrentPhase / 8 );
    Im[i][xFreq] += CurrentAmplitude * cos( 2 * Pi *
    CurrentPhase / 8 );
    Re[i][xFreq+1] += CurrentAmplitude * sin( 2 * Pi *
    CurrentPhase / 8 );
    Im[i][xFreq+1] += CurrentAmplitude * cos( 2 * Pi *
    CurrentPhase / 8 );
    }
```

where:

Amplitude, Freq and Phase are the same as previously defined.

Group is a number representing the base function transform size, 1 for the smallest transform and 5 for the largest.

length is the sub-frames for the Group and is given by: length=2^(Group−1).

>> is the shift right operator.

CurrentAmplitude and CurrentPhase are stored for the next sub-frame.

Envelope[Group] [i] is triangular shaped envelope of appropriate length (length) for each group, being zero valued at either end and having a value of 1 in the middle.

Re-synthesis of lower frequencies in the largest three transform sizes via the method described above, causes audible distortion in the output audio, therefore the following empirically based correction is applied to spectral lines less than 60 in groups 3, 4, and 5:

```
xFreq = Freq >> (Group − 1);
CurrentPhase = Phase − 2 * (2 * xFreq + 1);
f_dlt = Freq − (xFreq << (Group − 1));
for (i = 0; i < length; i = i + 1)
{
    CurrentPhase += 2 * (2 * Freq + 1) / length;
    CurrentAmplitude = Amplitude * Envelope[Group][i];
    Re_Amp = CurrentAmplitude * sin( 2 * Pi * CurrentPhase / 8);
    Im_Amp = CurrentAmplitude * cos( 2 * Pi * CurrentPhase / 8);
    a0 = Re_Amp * CorrCf[f_dlt][0];
    b0 = Im_Amp * CorrCf[f_dlt][0];
    a1 = Re_Amp * CorrCf[f_dlt][1];
    b1 = Im_Amp * CorrCf[f_dlt][1];
    a2 = Re_Amp * CorrCf[f_dlt][2];
    b2 = Im_Amp * CorrCf[f_dlt][2];
    a3 = Re_Amp * CorrCf[f_dlt][3];
    b3 = Im_Amp * CorrCf[f_dlt][3];
    a4 = Re_Amp * CorrCf[f_dlt][4];
    b4 = Im_Amp * CorrCf[f_dlt][4];
    Re[i][abs(xFreq − 2)] −= a4;
    Im[i][abs(xFreq − 2)] −= b4;
    Re[i][abs(xFreq − 1)] += (a3−a0);
    Im[i][abs(xFreq − 1)] += (b3−b0);
    Re[i][xFreq] += Re_Amp − a2 − a3;
    Im[i][xFreq] += Im_Amp − b2 − b3;
    Re[i][xFreq + 1] += a1 + a4 − Re_Amp;
    Im[i][xFreq + 1] += b1 + b4 − Im_Amp;
    Re[i][xFreq + 2] += a0 − a1;
    Re[i][xFreq + 3] += a2;
    Im[i][xFreq + 3] += a2;
}
```

where:

Amplitude, Freq, Phase, Envelope[Group][i], Group, and Length are all as previously defined.

CorrCf is given by Table 2 (FIG. 20).

abs(val) is a function which returns the absolute value of val

Since the bit stream does not contain any information as to the number of tonal components encoded, the decoder just reads tone data for each transform size until it runs out of data for that size. Thus, tonal components removed from the bit stream by external means, have no affect on the decoder's ability to handle data still contained in the bit stream. Removing elements from the bit stream just degrades audio quality by the amount of the data component removed. Tonal chunks can also be removed, in which case the decoder does not perform any reconstruction work of tonal components for that transform size.

Inverse Frequency Transform 604

The Inverse Frequency Transform 604 is the inverse of the transform used to create the frequency domain representation in the encoder. The current embodiment employs the inverse hierarchical filterbank described above. Alternately, an Inverse Fast Fourier Transform which is the inverse of the smallest FFT used to extract tones by the encoder provided overlapping FFTs were used at encode time.

Residual Decoder 602

A detailed block diagram of Residual Decoder 602 is shown in FIG. 18. Bit stream Parser 600 passes G1 elements from the bit stream to Grid Decoder 702 on line 610. Grid Decoder 702 decodes G1 to recreate G0 which is 32 frequency sub-bands by 64 time intervals. The bit stream contains quantized G1 values and the distances between those values. G1 values from the bit stream are dequantized using the same dequantization table as used to dequantize tonal component amplitudes. Linear interpolation between the values from the bit stream leads to 8 final G1 amplitudes for each G1 sub-band. Sub-bands 0 and 1 of G1 are initialized to zero, the zero values being replaced when sub-band information for these two sub-bands are found in the bit stream. These amplitudes are then weighted into the recreated G0 grid using the mapping weights 1900 obtained from Table 1 in FIG. 19. A general formula for G0 is given by:

$$G0_{m,n} = \sum_{k=0}^{10} (W_{m,k} \cdot G1_{k,\lfloor n/8 \rfloor})$$

where:

m is the sub-band number

W is the entry from table 1 n is the G0 column number k spans through 11 G1 subbands

Dequantizer 700

Time samples found by Bit stream Parser 600 are dequantized in Dequantizer 700. Dequantizer 700 dequantizes time samples from the bit stream using the inverse process of the encoder. Time samples from sub-band zero are dequantized to 16 levels, sub-bands 1 and 2 to 8 levels, sub-bands 11 through 25 to three levels, and sub-bands 26 through 31 to 2 levels. Any missing or invalid time samples are replaced with a pseudo-random sequence of values in the range of −1 to 1 having a white-noise spectral energy distribution. This improves scaled bit stream audio quality since such a sequence of values has characteristics that more closely resemble the original signal than replacement with zero values.

Channel Demuxer 701

Secondary channel information in the bit stream is stored as the difference from the primary channel for some sub-bands, depending on flags set in the bit stream. For these sub-bands, Channel Demuxer 701, restores values in the secondary channel from the values in the primary channel and difference values in the bit stream. If secondary channel information is missing the bit stream, secondary channel information can roughly be recovered from the primary channel by duplicating the primary channel information into secondary channels and using the stereo grid, to be subsequently discussed.

Channel Reconstruction 706

Stereo Reconstruction 706 is applied to secondary channels when no secondary channel information (time samples) are found in the bit stream. The stereo grid, reconstructed by Grid Decoder 702, is applied to the secondary time samples, recovered by duplicating the primary channel time sample information, to maintain the original stereo power ratio between channels.

Multichannel Reconstruction

Multichannel Reconstruction 706 is applied to secondary channels when no secondary information (either time samples or grids) for the secondary channels is present in the bit stream. The process is similar to Stereo Reconstruction 706, except that the partial grid reconstructed by Grid Decoder 702, is applied to the time samples of the secondary channel within each channel group, recovered by duplicating primary channel time sample information to maintain proper power level in the secondary channel. The partial grid is applied individually to each secondary channel in the reconstructed channel group following scaling by other scale factor grid(s) including grid G0 in the scaling step 703 by multiplying time samples of Grid G by corresponding elements of the partial grid for each secondary channel. The Grid G0, partial grids may be applied in any order in keeping with the present invention.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A method of encoding an input signal, comprising:

using a hierarchical filterbank (HFB) to decompose an input signal into a multi-resolution time/frequency representation;

extracting tonal components at multiple frequency resolutions from the time/frequency representation;

extracting residual components from the time/frequency representation;

ranking the components based on their relative contribution to decoded signal quality;

quantizing and encoding the components; and eliminating a sufficient number of the lowest ranked encoded components to form a scaled bit stream having a data rate less than or approximately equal to a desired data rate.

2. The method of claim 1, wherein the components are ranked by first grouping the tonal components into at least one frequency sub-domain at different frequency resolutions and grouping the residual components into at least one residual sub-domain at different time scales and/or frequency resolutions, ranking the sub-domains based on their relative contribution to decoded signal quality and ranking the components within each sub-domain based on their relative contribution to decoded signal quality.

3. The method of claim 2, further comprising:

forming a master bit stream in which the sub-domains and components within each sub-domain are ordered based on their ranking, said low ranking components being eliminated by starting with the lowest ranking component in the lowest ranking sub-domain and eliminating components in order until the desired data rate is achieved.

4. The method of claim 1, further comprising:

forming a master bit stream including the ranked quantized components, wherein the master bit stream is scaled by eliminating a sufficient number of low ranking components to form the scaled bit stream.

5. The method of claim 4, wherein the scaled bit stream is recorded on or transmitted over a channel having the desired data rate as a constraint.

6. The method of claim 5, wherein the scaled bit stream is one of a multiple of scaled bit streams and the data rate of each individual bit stream is controlled independently, with the constraint that the sum of individual data rates must not exceed a maximum total data rate, each said data rate being dynamically controlled in time in accordance with decoded signal quality across all bit streams.

7. The method of claim 1, wherein the residual components are derived from a residual signal between the input signal and the tonal components, whereby tonal components that are eliminated to form the scaled bit stream are also removed from the residual signal.

8. The method of claim 1, wherein the residual components include time-sample components and scale factor components that modify the time-sample components at different time scales and/or frequency resolutions.

9. The method of claim 8, wherein the time-sample components are represented by a grid G and the scale factor components comprise a series of one or more grids G0, G1 at multiple time scales and frequency resolutions that are applied to the time-sample components by dividing the grid G by grid elements of G0, G1 in the time/frequency plane, each grid G0, G1 having a different number of scale factors in time and/or frequency.

10. The method of claim 8, wherein the scale factors are encoded by applying a two-dimensional transform to the scale factor components and quantizing the transform coefficients.

11. The method of claim 10, wherein the transform is a two-dimensional Discrete Cosine Transform.

12. A method of claim 1, wherein the HFB decomposes the input signal into transform coefficients at successively lower frequency resolution levels at successive iterations, wherein said tonal and residual components are extracted by:

extracting tonal components from the transform coefficients at each iteration, quantizing and storing the extracted tonal components in a tone list;

removing the tonal components from the input signal to pass a residual signal to the next iteration of the HFB; and applying a final inverse transform with relatively lower frequency resolution than the final iteration of the HFB to the residual signal to extract the residual components.

13. The method of claim 12, further comprising:

removing some of the tonal components from the tone list after the final iteration; and locally decoding and inverse quantizing the removed quantized tonal components, and combining them with the residual signal at the final iteration.

14. The method of claim 13, wherein at least some of the relatively strong tonal components removed from the list are not locally decoded and recombined.

15. The method of claim 12, wherein the tonal components at each frequency resolution are extracted by:

identifying the desired tonal components through application of a perceptual model;

selecting the most perceptually significant of the transform coefficients;

storing parameters of each selected transform coefficient as the tonal component, said parameters including the amplitude, frequency, phase, and position in the frame of the corresponding transform coefficient; and quantizing and encoding the parameters for each tonal component in the tone list for insertion into the bit stream.

16. The method of claim 12, wherein the residual components include time-sample components represented as a Grid G, the extraction of the residual components further comprises:

constructing one or more scale-factor grids of different time/frequency resolutions, elements of which represent maximum signal values or signal energies in a time/frequency region;

dividing the elements of time-sample grid G by corresponding elements of the scale-factor grids to produce a scaled time sample grid G; and quantizing and encoding the scaled time-sample grid G and scale-factor grids for insertion into the encoded bit stream.

17. A method of claim 1, wherein the input signal is decomposed and the tonal and residual components are extracted by, (a) buffering samples of the input signal into frames of N samples;

(b) multiplying the N samples in each frame by an N-sample window function;

(c) applying an N-point transform to produce N/2 original transform coefficients;

(d) extracting tonal components from the N/2 original transform coefficients, quantizing and storing the extracted tonal components in a tone list;

(e) subtracting the tonal components by inverse quantizing and subtracting the resulting tonal transform coefficients from the original transform coefficients to give N/2 residual transform coefficients;

(f) dividing the N/2 residual transform coefficients into P groups of $M_i$ coefficients, such that the sum of the $M_i$ coefficients is $$N/2\left(\sum_{i=1}^{P} M_i = N/2;\right)$$

(g) for each of P groups, applying a $(2*M_i)$-point inverse transform to the residual transform coefficients to produce $(2*M_i)$ sub-band samples from each group;

(h) in each sub-band, multiplying the $2*M_i$ sub-band samples by a $2*M_i$ point window function;

(i) in each sub-band, overlapping with $M_i$ previous samples and adding corresponding values to produce $M_i$ new samples for each sub-band;

(j) repeating steps (a)-(i) on one or more of the sub-bands of $M_i$ new samples using successively smaller transform sizes N until the desired time/transform resolution is attained; and (k) Applying a final inverse transform with relatively lower frequency resolution N to the $M_i$ new samples for each sub-band output at the final iteration to produce sub-bands of time samples in a grid G of sub-bands and multiple time samples in each sub-band.

18. The method of claim 1, wherein the input signal is a multichannel input signal, each said tonal component being jointly encoded by forming groups of said channels and for each said group, Selecting a primary channel and at least one secondary channel, which are identified through a bitmask with each bit identifying the presence of a secondary channel, Quantizing and encoding the primary channel; and Quantizing and encoding the difference between the primary and each secondary channel.

19. The method of claim 18, wherein a joint channel mode for encoding each channel group is selected based on a metric that indicates which mode provides the least perceived distortion for the desired data rate in the decoded output signal.

20. The method of claim 1, wherein the input signal is a multichannel signal, further comprising:

subtracting the extracted tonal components from the input signal for each channel to form residual signals;

forming the channels of the residual signal into groups determined by perceptual criteria and coding efficiency;

determining primary and secondary channels for each said residual signal group;

calculating a partial grid to encode relative spatial information between each primary/secondary channel pairing in each residual signal group;

quantizing and encoding residual components for the primary channel in each group as respective grids G;

quantizing and encoding the partial grid to reduce the required data rate; and inserting the encoded partial grid and the grid G for each group into the scaled bit stream.

21. The method of claim 20, wherein the secondary channels are constructed from linear combinations of one or more channels.

22. A method of encoding an audio input signal, comprising:

decomposing an audio input signal into a multi-resolution time/frequency representation;

extracting tonal components at each frequency resolution;

removing the tonal components from the time/frequency representation to form a residual signal;

extracting residual components from the residual signal;

grouping the tonal components into at least one frequency sub-domain;

grouping the residual components into at least one residual sub-domain;

ranking the sub-domains based on psychoacoustic importance;

ranking the components within each sub-domain based on psychoacoustic importance;

quantizing and encoding the components within each sub-domain; and eliminating a sufficient number of the low ranking components from the lowest ranked sub-domains to form a scaled bit stream having a data rate less than or approximately equal to a desired data rate.

23. The method of claim 22, wherein the tonal components are grouped into a plurality of frequency sub-domains at different frequency resolutions and said residual components include grids that are grouped into a plurality of residual sub-domains at different frequency and/or time resolutions.

24. The method of claim 22, further comprising:

forming a master bit stream in which the sub-domains and components within each sub-domain are ordered based on their ranking, said low ranking components being eliminated by starting with the lowest ranking component in the lowest ranking sub-domain and eliminating components in order until the desired data rate is achieved.

25. A scalable bit stream encoder for encoding an input audio signal and forming a scalable bit stream, comprising:

a hierarchical filterbank (HFB) that decomposes the input audio signal into transform coefficients at successively lower frequency resolution levels and back into time-domain sub-band samples at successively finer time scales at successive iterations;

a tone encoder that (a) extracts tonal components from the transform coefficients at each iteration, quantizes and stores them in a tone list, (b) removes the tonal components from the input audio signal to pass a residual signal to the next iteration of the HFB and (c) ranks all of the extracted tonal components based on their relative contribution to decoded signal quality;

a residual encoder that applies a final inverse transform with relatively lower frequency resolution than the final iteration of the HFB to the final residual signal to extract the residual components and ranks the residual components based on their relative contribution to decoded signal quality;

a bit stream formatter that assembles the tonal and residual components on a frame-by-frame bases to form a master bit stream; and a scaler that eliminates a sufficient number of the lowest ranked encoded components from each frame of the master bit stream to form a scaled bit stream having a data rate less than or approximately equal to a desired data rate.

26. The encoder of claim 25, wherein the tone encoder groups the tonal components into frequency sub-domains at different frequency resolutions and ranks the components with each sub-domain, the residual encoder groups the residual components into residual sub-domains at different time scales and/or frequency resolutions and ranks the components with each sub-domain, and said bit stream formatter ranks the sub-domains based on their relative contribution to decoded signal quality.

27. The encoder of claim 26, wherein the bit stream formatter orders the sub-domains and the components within each sub-domain based on their ranking, said scaler eliminating said low ranking components being by starting with the lowest ranking component in the lowest ranking sub-domain and eliminating components in order until the desired data rate is achieved.

28. The encoder of claim 25, wherein the input audio signal is a multichannel input audio signal, said tone encoder jointly encoded each said tonal components by forming groups of said channels and for each said group, selecting a primary channel and at least one secondary channel, which are identified through a bitmask with each bit identifying the presence of a secondary channel;

quantizing and encoding the primary channel; and quantizing and encoding the difference between the primary and each secondary channel.

29. The encoder of claim 25, wherein the input signal is a multichannel audio signal, said residual encoder, forming the channels of the residual signal into groups determined by perceptual criteria and coding efficiency;

determining primary and secondary channels for each said residual signal group;

calculating a partial grid to encode relative spatial information between each primary/secondary channel pairing in each residual signal group;

quantizing and encoding residual components for the primary channel in each group as respective grids G;

quantizing and encoding the partial grid to reduce the required data rate; and inserting the encoded partial grid and the grid G for each group into the scaled bit stream.

30. The encoder of claim 25, wherein the residual encoder extracts time-sample components represented by a grid G and a series of one or more scale factor grids G0, G1 at multiple time and frequency resolutions that are applied to the time-sample components by dividing the grid G by grid elements of G0, G1 in the time/frequency plane, each grid G0, G1 having a different number of scale factors in time and/or frequency.

31. A method of reconstructing a time-domain output signal from an encoded bit stream, comprising:

receiving a scaled bit stream having a predetermined data rate within a given range as a sequence of frames, each frame containing at least one of the following (a) a plurality of quantized tonal components representing frequency domain content at different frequency resolutions of the input signal, b) quantized residual time-sample components representing the time-domain residual formed from the difference between the reconstructed tonal components and the input signal, and c) scale factor grids representing signal energies of the residual signal, which at least partially span a frequency range of the input signal;

receiving information for each frame about the position of the quantized components and/or grids within the frequency range;

parsing the frames of the scaled bit stream into the components and grids;

decoding any tonal components to form transform coefficients;

decoding any time-sample components and any grids;

multiplying the time-sample components by grid elements to form time-domain samples; and applying an inverse hierarchical filterbank to the transform coefficients and time-domain samples to reconstruct a time-domain output signal.

32. The method of claim 31, wherein the time-domain samples are formed by, parsing the bit stream into a scale factor Grid Gland the time-sample components;

decoding and inverse quantizing grid G1 scale factor grid to produce a G0 scale factor grid; and decoding and inverse quantizing the time-sample components, multiplying those time-sample values by G0 scale factor grid values to produce reconstructed time-samples.

33. The method of claim 32, wherein the signal is a multichannel signal in which the residual channels have been grouped and encoded, each said frame also containing d)

partial grids representing the signal energy ratios of the residual signal channels within channel groups further comprising:

parsing the bit stream into the partial grids;

decoding and inverse quantizing the partial grids; and multiplying the reconstructed time-samples by the partial grid applied to each secondary channel in a channel group to produce the reconstructed time-domain samples.

34. The method of claim 31, wherein the input signal is multichannel in which tonal components groups containing a primary and one or more secondary channels, each said frame also containing e) a bitmask associated with the primary channel in each group in which each bit identifies the presence of a secondary channel that has been jointly encoded with the primary channel, parsing the bit stream into the bitmasks;

decoding the tonal components for the primary channel in each group;

decoding the jointly encoded tonal components in each group;

for each group, using the bitmask to reconstruct the tonal components for each said secondary channel from the tonal components of primary channel and the jointly encoded tonal components.

35. The method of claim 34, wherein the secondary channel tonal components are decoded by decoding the difference information between the primary and secondary frequencies, amplitudes and phases being entropy-coded and stored for each secondary channel in which the tonal component is present.

36. The method of claim 31, wherein the inverse hierarchical filterbank reconstructs the output signal by transforming the time-domain samples into residual transform coefficients, combining them with the transform coefficients for a set of tonal components at a low frequency resolution and inverse transforming the combined transform coefficients to form a partially reconstructed output signal, and repeating the steps on this partially reconstructed output signal with the transform coefficients for another set of tonal components at the next highest frequency resolution until the output signal is reconstructed.

37. The method of claim 36, wherein the time-domain samples are represented as sub-bands, said inverse hierarchical filterbank reconstructing the time-domain output signal by:

a) windowing the signal(s) in each of the time-domain sub-bands of the input frame to form windowed time-domain sub-bands;

b) applying a time-to-frequency domain transform to each of the windowed time-domain sub-bands to form transform coefficients;

c) concatenating the resulting transform coefficients to form larger set(s) of the residual transform coefficients;

d) synthesizing the transform coefficients from the set of tonal components;

e) combining the transform coefficients reconstructed from the tonal and time-domain components into a single set of combined transform coefficients;

f) applying an inverse transform to the combined transform coefficients, windowing and overlap adding with the previous frame to reconstruct a partially reconstructed time domain signal; and g) applying successive iterations of steps (a) to (f) on the partially reconstructed time domain signal(s) using the next set of tonal components until the time-domain output signal is reconstructed.

38. The method of claim 36, in which each input frame contains $M_i$ time samples in each of P sub-bands, said inverse hierarchical filterbank performing the following steps:

a) in each sub-band i, buffering and concatenated the $M_i$ previous samples with the current $M_i$ samples to produce $2*M_i$ new samples;

b) in each sub-band i, multiplying the $2*M_i$ sub-band samples by a $2*M_i$ point window function;

c) applying a $(2*M_i)$-point transform to the sub-band samples to produce $M_i$ transform coefficients for each sub-band i;

d) concatenating the $M_i$ transform coefficients for each sub-band i to form a single set of N/2 coefficients;

e) synthesizing tonal transform coefficients from the decoded and inverse quantized set of tonal components and combining them with the concatenated coefficients of the previous step to form a single set of combined concatenated coefficients;

f) applying an N-point inverse transform to the combined concatenated coefficients to produce N samples;

g) multiplying each Frame of N samples by an N-sample window function to produce N windowed samples;

h) overlap adding the resulting windowed samples to produce N/2 new output samples at the given sub-band level as the partially reconstructed output signal; and i) repeating steps (a)-(h) on the N/2 new output samples using the next set of tonal components until all sub-bands have been processed and the N original time samples are reconstructed as the output signal.

39. A decoder for reconstructing a time-domain output audio signal from an encoded bit stream, comprising:

a bit stream parser for parsing each frame of a scaled bit stream into its audio components, each frame containing at least one of the following (a) a plurality of quantized tonal components representing frequency domain content at different frequency resolutions of the input signal, b) quantized residual time-sample components representing the time-domain residual formed from the difference between the reconstructed tonal components and the input signal, and c) scale factor grids representing the signal energies of the residual signal;

a residual decoder for decoding any time-sample components and any grids to reconstruct time samples;

a tonal decoder for decoding any tonal components to form transform coefficients; and an inverse hierarchical filterbank that reconstructs the output signal by transforming the time samples into residual transform coefficients, combining them with the transform coefficients for a set of the tonal components at a low frequency resolution and inverse transforming the combined transform coefficients to form a partially reconstructed output signal, and repeating the steps on this partially reconstructed output signal with the transform coefficients for another set of tonal components at the next highest frequency resolution until the output audio signal is reconstructed.

40. The decoder of claim 39, wherein each input frame contains $M_i$ time samples in each of P sub-bands, said inverse hierarchical filterbank performing the following steps:

a) in each sub-band i, buffering and concatenated the $M_i$ previous samples with the current $M_i$ samples to produce $2*M_i$ new samples;

b) in each sub-band i, multiplying the $2*M_i$ sub-band samples by a $2*M_i$ point window function;

c) applying a $(2*M_i)$-point transform to the sub-band samples to produce $M_i$ residual transform coefficients for each sub-band i;

d) concatenating the $M_i$ residual transform coefficients for each sub-band i to form a single set of N/2 coefficients;

e) synthesizing tonal transform coefficients from the decoded and inverse quantized set of tonal components and combining them with the concatenated residual transform coefficients to form a single set of combined concatenated coefficients;

f) applying an N-point inverse transform to the combined concatenated coefficients to produce N samples;

g) multiplying each Frame of N samples by an N-sample window function to produce N windowed samples;

h) overlap adding the resulting windowed samples to produce N/2 new output samples at the given sub-band level as the partially reconstructed output signal; and i) repeating steps (a)-(h) on the N/2 new output samples using the next set of tonal components until all sub-bands have been processed and the N original time samples are reconstructed as the output signal.

41. A method of hierarchically filtering an input signal to achieve a nearly arbitrary time/frequency decomposition, comprising the steps of:

(a) buffering samples of the input signal into frames of N samples;

(b) multiplying the N samples in each frame by an N-sample window function;

(c) applying an N-point transform to produce N/2 transform coefficients;

(d) dividing the N/2 residual transform coefficients into P groups of $M_i$ coefficients, such that the sum of the $M_i$ coefficients is $$N/2\left(\sum_{i=1}^{P} M_i = N/2;\right)$$

(e) for each of P groups, applying a $(2*M_i)$-point inverse transform to the transform coefficients to produce $(2*M_i)$ sub-band samples from each group;

(f) in each sub-band i, multiplying the $(2*M_i)$ sub-band samples by a $(2*M_i)$-point window function;

(g) in each sub-band i, overlapping with $M_i$ previous samples and adding corresponding values to produce $M_i$ new samples for each sub-band; and (h) repeating steps (a)-(g) on one or more of the sub-bands of $M_i$ new samples using successively smaller transform sizes N until the desired time/transform resolution is achieved.

42. The method of claim 41, wherein the transform is an MDCT transform.

43. The method of claim 41, wherein steps (a)-(g) are repeated on all of the sub-bands of $M_i$.

44. The method of claim 41, wherein steps (a)-(g) are repeated on only a defined set of low frequency sub-bands of $M_i$.

45. A method of hierarchically reconstructing time samples of an input signal, in which each input frame contains $M_i$ time samples in each of P sub-bands, comprising performing the following steps:

a) in each sub-band i, buffering and concatenating the $M_i$ previous samples with the current $M_i$ samples to produce $2*M_i$ new samples;

b) in each sub-band i, multiplying the $2*M_i$ sub-band samples by a $2*M_i$ point window function;

c) applying a $(2*M_i)$-point transform to the windowed sub-band samples to produce $M_i$ transform coefficients for each sub-band i;

d) concatenating the $M_i$ transform coefficients for each sub-band i to form a single group of N/2 coefficients;

e) applying an N-point inverse transform to the concatenated coefficients to produce a frame of N samples;

f) multiplying each frame of N samples by an N-sample window function to produce N windowed samples;

g) overlap adding the resulting windowed samples to produce N/2 new output samples at the given sub-band level; and h) repeating steps (a) through (g) until all sub-bands have been processed and the N original time samples are reconstructed.

* * * * *